US011641059B2

(12) United States Patent
Huang et al.

(10) Patent No.: US 11,641,059 B2
(45) **Date of Patent: *May 2, 2023**

(54) WIRELESS COMMUNICATION STRUCTURE, DISPLAY PANEL AND WIRELESS COMMUNICATION DEVICE

(71) Applicant: Yungu (Gu'an) Technology Co., Ltd., Hebei (CN)

(72) Inventors: Huan-Chu Huang, Taoyuan (CN); Shuang Cui, Langfang (CN); Jie Wu, Langfang (CN)

(73) Assignee: Yungu (Gu'an) Technology Co., Ltd., Hebei (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/889,976

(22) Filed: Aug. 17, 2022

(65) Prior Publication Data

US 2022/0407228 A1 Dec. 22, 2022

(51) Int. Cl.
*H01Q 5/50* (2015.01)
*H01Q 7/00* (2006.01)

(52) U.S. Cl.
CPC ..... *H01Q 7/00* (2013.01); *H01Q 5/50* (2015.01)

(58) Field of Classification Search
CPC ..... H01Q 7/00; H01Q 5/50; H01Q 7/005; H01Q 1/44; H01Q 1/2291; H01Q 1/36; H01Q 1/243; H01Q 1/273; H01Q 1/38; H01Q 1/50; H01Q 21/00; H01Q 7/06; G06F 3/0416; G06F 3/046; H04B 1/40
See application file for complete search history.

(56) References Cited

U.S. PATENT DOCUMENTS

2007/0024399 A1* 2/2007 Martin Antolin ..... H01Q 7/00 333/205
2011/0095848 A1* 4/2011 Dounaevski ..... H03H 7/0115 333/181

(Continued)

FOREIGN PATENT DOCUMENTS

CN 201898208 U 7/2011
CN 106450725 A 2/2017

(Continued)

OTHER PUBLICATIONS

The Notice of Allowance dated Sep. 1, 2022, in corresponding Korean Application No. 10-2022-0101574, 4 pages (with English translation).

(Continued)

*Primary Examiner* — Hai V Tran
*Assistant Examiner* — Michael M Bouizza
(74) *Attorney, Agent, or Firm* — Maier & Maier, PLLC

(57) ABSTRACT

A wireless communication structure, a display panel and a wireless communication device, the wireless communication structure includes: a loop structure including a first connection end, a second connection end and a coil body, at least a part of the coil body being connected between the first connection end and the second connection end; an antenna connected to the coil body. The antenna is connected to the coil body of the loop structure, so that not only the loop structure and the antenna can be arranged in a limited space, but also a desired optical performance of the display screen can be ensured.

15 Claims, 37 Drawing Sheets

(56) References Cited

U.S. PATENT DOCUMENTS

| | | | | |
|---|---|---|---|---|
| 2014/0269217 | A1* | 9/2014 | Jenwatanavet | H01Q 9/42 343/702 |
| 2016/0093939 | A1* | 3/2016 | Kim | H01Q 1/50 343/720 |
| 2021/0055411 | A1 | 2/2021 | Lee et al. | |
| 2022/0069440 | A1* | 3/2022 | Byun | H01Q 1/243 |

FOREIGN PATENT DOCUMENTS

| | | | | |
|---|---|---|---|---|
| CN | 109411873 | A | | 3/2019 |
| CN | 110190397 | A | | 8/2019 |
| CN | 110265771 | A | * | 9/2019 |
| CN | 110970709 | A | | 4/2020 |
| CN | 210270841 | U | | 4/2020 |
| CN | 210270842 | U | | 4/2020 |
| CN | 111952713 | A | | 11/2020 |
| CN | 111952733 | A | | 11/2020 |
| CN | 112350053 | A | | 2/2021 |
| CN | 111541032 | B | | 8/2021 |
| CN | 114188731 | A | | 3/2022 |
| CN | 114204286 | A | | 3/2022 |
| CN | 114327146 | A | | 4/2022 |
| CN | 114530693 | A | | 5/2022 |
| JP | 2021136389 | A | | 9/2021 |
| KR | 10-2015-0127788 | A | | 11/2015 |
| KR | 10-2021-0093356 | A | | 7/2021 |

OTHER PUBLICATIONS

The Letters Patent for Korean Application dated Sep. 8, 2022, in corresponding to Korean Application No. 10-2022-0101574, 49 pages (with English Translation).

The First Office Action for Chinese Application No. 202210433184.5, dated Jun. 2, 2022, 20 pages.

The Second Office Action for Chinese Application No. 202210433184.5, dated Jun. 24, 2022, 19 pages.

The Notification to Grant Patent Right for Invention for Chinese Application No. 202210433184.5, dated Jul. 21, 2022, 7 pages.

Office Action dated Nov. 15, 2022, in corresponding Japanese Patent Application No. 2022-129449; Concise Explanation of Relevance in English is provided; 4 pages.

International Search Report dated Jan. 18, 2023, in corresponding International Patent Application No. PCT/CN2022/109242; 11 pages.

* cited by examiner

WIRELESS COMMUNICATION STRUCTURE, DISPLAY PANEL AND WIRELESS COMMUNICATION DEVICE

CROSS-REFERENCE TO RELATED APPLICATION

This application claims priority to Chinese Patent Application No. 202210433184.5, filed on Apr. 24, 2022, which is hereby incorporated by reference in its entirety.

TECHNICAL FIELD

The present application relates to the technical field of display devices, and particularly to a wireless communication structure, a display panel and a wireless communication device.

BACKGROUND

Handheld wireless communication devices (e.g. cell phones, smart watches, etc.) are becoming increasingly functional, and market requirements for device appearance and wireless communication performance are also becoming more and more demanding. In the era of the 5th generation mobile communications (5G), since both millimeter-waves (mm-waves) and non-millimeter waves (non-millimeter-waves) are involved, types and numbers of antennas in a handheld wireless communication device are increasing. In addition, functions of near field communication (NFC) are becoming increasingly popular, so NFC coils also have been provided in more and more handheld wireless communication devices.

Meanwhile, screen-to-body ratios of the handheld wireless communication devices are becoming higher and higher. Therefore, since overall sizes of the devices cannot be significantly increased, arranging wireless communication modules in display panels is a critical technology trend in foreseeable future. However, internal spaces of the display panels are limited and have optical requirements, so how to arrange the wireless communication modules in the display panels has become an important technical problem to be solved urgently.

SUMMARY

Embodiments of the present application provide a wireless communication structure, a display panel, and a wireless communication device, in order to solve the problem of how to arrange the wireless communication module in a limited space and ensure a desired optical performance of the display panel.

An embodiment of a first aspect of the present application provides a wireless communication structure comprising: a loop structure comprising a first connection end, a second connection end and a coil body, at least a part of the coil body being connected between the first connection end and the second connection end; an antenna connected to the coil body, wherein the antenna comprises a non-millimeter-wave antenna, the non-millimeter-wave antenna comprises a non-millimeter-wave radiating portion and a non-millimeter-wave feeding portion, and the non-millimeter-wave radiating portion is connected to the coil body; wherein the coil body is provided with one or more first blocking portions, the one or more first blocking portions are configured to allow wireless signal currents transmitted and/or received by the loop structure to pass through and block non-millimeter-wave wireless signal currents transmitted and/or received by the non-millimeter-wave antenna.

According to an implementation of the first aspect of the present application, the one or more first blocking portions comprise a plurality of first blocking portions, and the plurality of first blocking portions are arranged on both sides of the non-millimeter-wave radiating portion.

According to any implementation of the first aspect of the present application, the antenna further comprises one or more millimeter-wave antenna units, and the one or more millimeter-wave antenna units are connected to the coil body.

According to any implementation of the first aspect of the present application, at least one of the millimeter-wave antenna units is reused as a part of the non-millimeter-wave radiating portion.

According to any implementation of the first aspect of the present application, the coil body is provided with one or more second blocking portions, the one or more second blocking portions are configured to allow wireless signal currents transmitted and/or received by the loop structure and non-millimeter-wave currents transmitted and/or received by the non-millimeter-wave antenna to pass through, and the one or more second blocking portions are configured to block millimeter-wave currents transmitted and/or received by the one or more millimeter-wave antenna units, wherein line widths of one or more the second blocking portions are greater than line widths of the one or more first blocking portions.

According to any implementation of the first aspect of the present application, the one or more second blocking portions comprise a plurality of second blocking portions, and the plurality of second blocking portions are arranged on both sides of one of the one or more millimeter-wave antenna units.

According to any implementation of the first aspect of the present application, the non-millimeter wave radiating portion further comprises a first connection wire for connecting a millimeter-wave antenna unit to the non-millimeter-wave feeding portion, and the first connection wire is a part of the coil body.

According to any implementation of the first aspect of the present application, the one or more millimeter-wave antenna units comprise a plurality of millimeter-wave antenna units, and two or more of the plurality of millimeter-wave antenna units form a millimeter-wave antenna array in combination.

According to any implementation of the first aspect of the present application, each of the plurality of millimeter-wave antenna units in the millimeter-wave antenna array is connected to the coil body, and one of the one or more first blocking portions is arranged between adjacent millimeter-wave antenna units in the millimeter-wave antenna array.

According to any implementation of the first aspect of the present application, the coil body is provided with a second blocking portion, the second blocking portion is connected between adjacent millimeter-wave antenna units, the second blocking portion is configured to allow wireless signal currents transmitted and/or received by the loop structure and non-millimeter-wave currents transmitted and/or received by the non-millimeter-wave antenna to pass through, and the second blocking portion is configured to block millimeter-wave currents transmitted and/or received by the millimeter-wave antenna units.

According to any implementation of the first aspect of the present application, the millimeter-wave antenna units are spaced apart from the non-millimeter-wave radiating portion on an extending path of the coil body, and at least one of the one or more first blocking portions is arranged between the millimeter-wave antenna units and the non-millimeter-wave radiating portion.

According to any implementation of the first aspect of the present application, the loop structure is configured to transmit and/or receive wireless signals in non-millimeter-wave band, the coil body is configured to transmit and/or receive wireless signals in non-millimeter-wave band by coupling.

An embodiment of a second aspect of the present application further provides a display panel comprising the wireless communication structure according to any of the above embodiments of the first aspect.

According to an implementation of the second aspect of the present application, the display panel further comprises a touch layer, wherein the touch layer comprises mesh-shaped metal wiring, and both the loop structure and the antenna are positioned in the touch layer.

According to any implementation of the second aspect of the present application, the display panel comprises a first area and a second area surrounding the first area, the first area is a display area, the second area comprises a display area and/or a non-display area, and the loop structure is positioned in the second area; wherein the coil body is arranged in the second area and surrounds the first area.

An embodiment of a third aspect of the present application provides a wireless communication device, comprising the display panel according to any of the above embodiments of the second aspect.

In the wireless communication structure provided by an embodiment of the present application, the wireless communication structure includes the loop structure and the antenna. The loop structure includes the first connection end, the second connection end and the coil body, and is configured to transmit and/or receive wireless signals on the coil body through the first connection end and the second connection end. Since the antenna is connected to the coil body of the loop structure, at least a part of the coil body may transmit and/or receive wireless signals of the loop structure and wireless signals of the antenna at the same time. An overall area occupied by the loop structure and the antenna can be reduced, so that two or more antennas may be disposed in a limited space, and thus the influence on the optical performance of the display screen can be reduced, so that a desired optical performance of the display screen is ensured. Besides, a patterning process of the antenna is simplified, thereby improving the manufacturing efficiency of the antenna and reducing the manufacturing cost.

BRIEF DESCRIPTION OF THE DRAWINGS

Features, objects and advantages of the present application will be clearer from the detailed description of following reference drawings of non-limited embodiments, wherein the same or similar reference numerals and/or letters mean the same or similar features.

DETAILED DESCRIPTION

Figure 1:
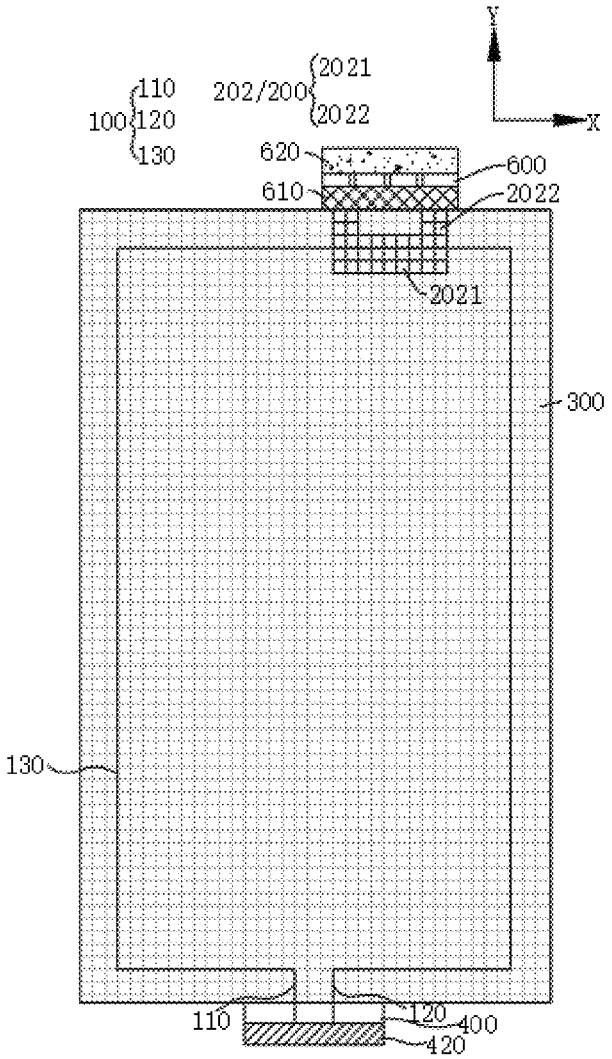
FIG. 1 is a schematic structural view of a wireless communication structure of a display panel according to a first embodiment of a first aspect of the present application.

Features and exemplary embodiments of various aspects of the present application are described in detail below. In the following detailed description, numerous specific details are presented to provide a thorough understanding of the present application. However, it will be apparent for those skilled in the art that the present application may be implemented without some of these specific details. The following description of the embodiments is merely for providing a better understanding of the present application by illustrating examples of the present application. In the drawings and the following description, at least some of well know structures and techniques have not been shown to avoid unnecessary obscurity of the present application. In addition, size of some structures may be exaggerates for clarity. Furthermore, the features, structures, or characteristics described below may be combined in one or more embodiments by any suitable manner.

In the description of the present application, it should be noted that, unless otherwise specified, directional or positional relationships indicated by terms "upper", "lower", "left", "right", "inner", "outer" and the like are merely used for the ease and simplicity of description of the present application, and are not used for indicating or implying that apparatuses or elements modified by these terms must be positioned in the indicated directions, or configured or operating in the indicated directions, and therefore should not be interpreted as a limitation on the present application. In addition, terms "first", "second", and the like are merely used for the purpose of description and should not be interpreted as indicating or implying relative importance.

The directional terms appearing in the following description are referred to directions shown in the drawings and do not limit the specific structures of the present application. In the description of the present application, it should be further noted that, unless otherwise clearly specified and limited, the terms "mounted" and "connected" should be understood in a broad sense, for example, a connection may refer to a fixed, a detachable or an integrated connection (which may be a direct connection or a indirect connection). For those with ordinary skills in the art, the specific meaning of the terms mentioned above in the present application can be understood in accordance with specific contexts.

With the development of display technology and wireless communication technology, screen-to-body ratios of display apparatuses in devices with wireless communication functions are continually increasing, and types and numbers of transmission modules used to achieve wireless communication in the devices are also increasing. For example, in the era of 5th generation mobile communications, spectrum of wireless communication covers both millimeter waves and non-millimeter waves. Therefore, a wireless communication device with 5G mm-wave functions, such as a mobile phone, not only may have provided therein a first type antenna that can be used for millimeter waves, but also usually may have provided therein wireless communication modules that can be used for non-millimeter waves (such as those used for 5G, 4G, WLAN (wireless local area network), BT (Bluetooth), GNSS (global navigation satellite system), etc.). At the same time, NFC (Near Field Communication) is also becoming increasingly popular, and therefore, more and more mobile phones also have NFC coils provided therein.

However, the higher the screen-to-body ratio of the display apparatus in the wireless communication device is, the more liable it is to limit the positions where the wireless communication modules can be positioned, and the more liable it is to block the wireless communication modules when the device is being used (for example, the device is being held by hand or placed on a metal table), which results in significant degradation of antenna performance and affects user's wireless experience. In view of the above, it is contemplated that the wireless communication modules are integrated in the display apparatus of the wireless communication device, for example, in a design manner of Antenna-on-Display (AoD), which has become a possible direction of development for antenna designs in wireless communication devices.

Figure 48:
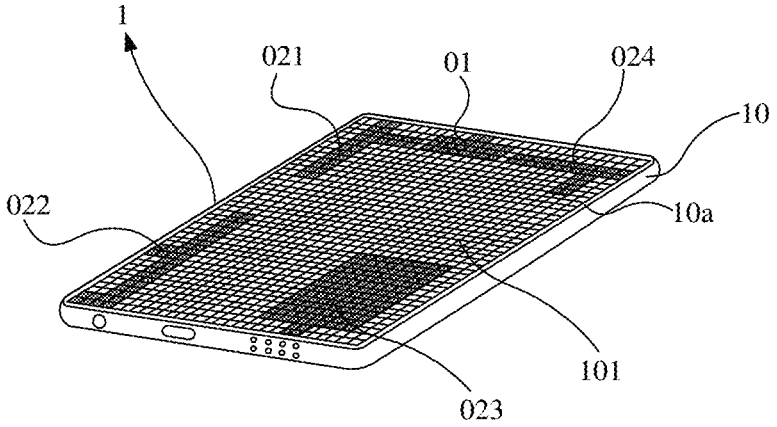
FIG. 48 is a schematic structural view of a wireless communication device in the related art.

In some embodiments, with reference to FIG. 48, take the wireless communication device 1 being a mobile phone as an example, wireless communication modules integrated in a display apparatus 10 of a mobile phone may include a 5G millimeter-wave antenna 01, a WiFi/BT antenna 021, a Long Term Evolution (LTE) antenna 022, an NFC coil 023, and a 5G non-millimeter-wave antenna 024. Typically, the 5G millimeter-wave antenna 01, the WiFi/BT antenna 021, the LTE antenna 022, the NFC coil 023 and the 5G non-millimeter-wave antenna 024 are arranged in the display apparatus 10 independently from one another. However, an internal space of the display apparatus 10 is limited, and how to arrange the wireless communication modules in the limited space and ensure desired optical and touch effects of the display panel has become a technical problem to be solved urgently.

In order to solve the problem above, the present application is presented. For a better understanding of the present application, the wireless communication structure, the display panel and the wireless communication device of embodiments of the present application are described in detail below with reference to FIG. 1 to FIG. 47.

Reference is made to FIG. 1, which is a schematic structural view of a display panel according to a first embodiment of the present application.

As shown in FIG. 1, the display panel provided by an embodiment of the present application includes a wireless communication structure. The wireless communication structure may be configured in various manners. As shown in FIG. 1, the wireless communication structure provided by an embodiment of the first aspect of the present application includes a loop structure 100 and antenna 200. The loop structure 100 includes a first connection end 110, a second connection end 120, and a coil body 130. At least a part of the coil body 130 is connected between the first connection end 110 and the second connection end 120. The antenna 200 is connected to the coil body 130.

In the wireless communication structure provided by an embodiment of the present application, the wireless communication structure includes the loop structure 100 and the antenna 200. The loop structure 100 includes the first connection end 110, the second connection end 120 and the coil body 130, and is configured to transmit and/or receive wireless signals on the coil body 130 through the first connection end 110 and the second connection end 120. Since the antenna 200 is connected to the coil body 130 of the loop structure 100, at least a part of the coil body 130 may transmit and/or receive wireless signals of the loop structure 100 and wireless signals of the antenna 200 at the same time. An overall area occupied by the loop structure 100 and the antenna 200 can be reduced, so that two or more antennas 200 may be arranged in a limited space, and thus the influence on the optical performance of the display screen can be reduced, so that a desired optical performance of the display screen is ensured. Besides, a patterning process of the antenna 200 is simplified, thereby improving the manufacturing efficiency of the antenna 200 and reducing the manufacturing cost.

Optionally, the antenna includes a feeding portion and a radiating portion, either of which may be connected to the coil body 130. Alternatively, both the feeding portion and the radiating portion are connected to the coil body 130. In an embodiment of the present application, the radiating portion of the antenna 200 being connected to the coil body 130 is taken as an example for illustration.

As an optional embodiment, with further reference to FIG. 1, when the wireless communication structure is used in a display panel, the display panel further includes a touch layer 300 including mesh-shaped metal wires, which are illustrated as light-colored mesh-shaped lines in FIG. 1. The touch layer 300 includes a touch structure for realizing a touch function of the display panel. The loop structure 100 and the antenna 200 are arranged in the touch layer 300, which means the touch structure, the loop structure 100 and the antenna 200 are arranged on a same layer. When the loop structure 100 and the antenna 200 are arranged in the touch layer 300, at least one loop structure 100 is connected to the antenna 200. This can reduce the number of cutting points of the mesh-shaped metal wires, thus improving degradation of touch performance and experience due to expansion of touch blind areas caused by the disposition of the antenna 200 in the touch layer 300, that is, a desired touch performance of the display screen can be ensured. Additionally, at least one loop structure 100 is connected to the antenna 200, which can reduce the number of cutting points of the mesh-shaped metal wires, so that patterns formed by mesh-shaped metal wires in different areas tend to be uniform, which can also improve optical effect of the display panel.

Optionally, the loop structure 100 is a looped coil, which can be configured in various manners. For example, the loop structure 100 includes at least one of a NFC coil, a wireless power charging (WPC) coil, a LTE coil, a global positioning GNSS coil, a WLAN coil, a frequency modulation (FM) coil, and the like. The NFC coil, the WPC coil, the LTE coil, the GNSS coil, the WLAN coil, the FM coil and the like may each be configured as a looped coil, to facilitate the connection of the antenna 200 therewith.

Optionally, the loop structure 100 includes at least one of the NFC coil and the WPC coil. Because a size of the loop structure 100 including the NFC coil and/or the WPC coil is generally large. For example, the loop structure 100 including the NFC coil and/or the WPC coil are arranged close to and around edges of the display panel to facilitate the connection of the antenna 200 with the loop structure100 including the NFC coil and/or the WPC coil, and the antenna 200 is able to be arranged closer to the edges of the display panel. As such, the degradation of the optical and touch effects of the display panel caused by the antenna 200 can be insignificant, and a feeding path of the antenna 200 can be short, so the feeding loss can be low and a desired radiation performance of antenna 200 is achieved.

Optionally, the loop structure 100 is configured to transmit and/or receive wireless signals in non-millimeter-wave band. Transmitting and/or receiving wireless signals in non-millimeter-wave band refers to receiving and/or sending wireless signals in non-millimeter-wave band, that is, to transmit and/or receive means to receive and/or send herein.

For example, the loop structure 100 is a coupled coil configured to transmit the wireless signals in the non-millimeter-wave band through coupling. The loop structure 100 is configured to transmit signals through coupling, and the antenna 200 is configured to transmit signals through radiation, that is, the wireless communication structure may be configured to implement two different manners of wireless signal transmission.

Optionally, the loop structure 100 and the antenna 200 are each configured for wireless communication and have a corresponding frequency band.

For example, the loop structure 100 is the NFC coil, of which a communication frequency band is, for example, 13.56 MHz. Alternatively, the loop structure 100 is the WPC coil, and a communication frequency band of a commonly used WPC coil is, for example, higher than or equal to 100 kHz. The NFC coil and the WPC coil are coupled coils used in non-mobile wireless communication (because currently the NFC coil and the WPC coil need to be geologically referenced to a counterpart communication apparatus).

The loop structure 100 may include a coupling portion and a feeding portion. For example, the coil body 130 is the coupling portion of the loop structure 100. The first connection end 110 and the second connection end 120 are the feeding portion of the loop structure 100. The loop structure 100 may be configured for short-distance point-to-point wireless communication.

Optionally, the loop structure 100 may further include the FM coil. A common FM frequency band is 87 MHz to 108 MHz, and the FM coil is applied to long-distance non-mobile wireless communication.

There are various manners to set the number of antennas 200. As shown in FIG. 1, the number of antennas 200 may be one.

Figure 2:
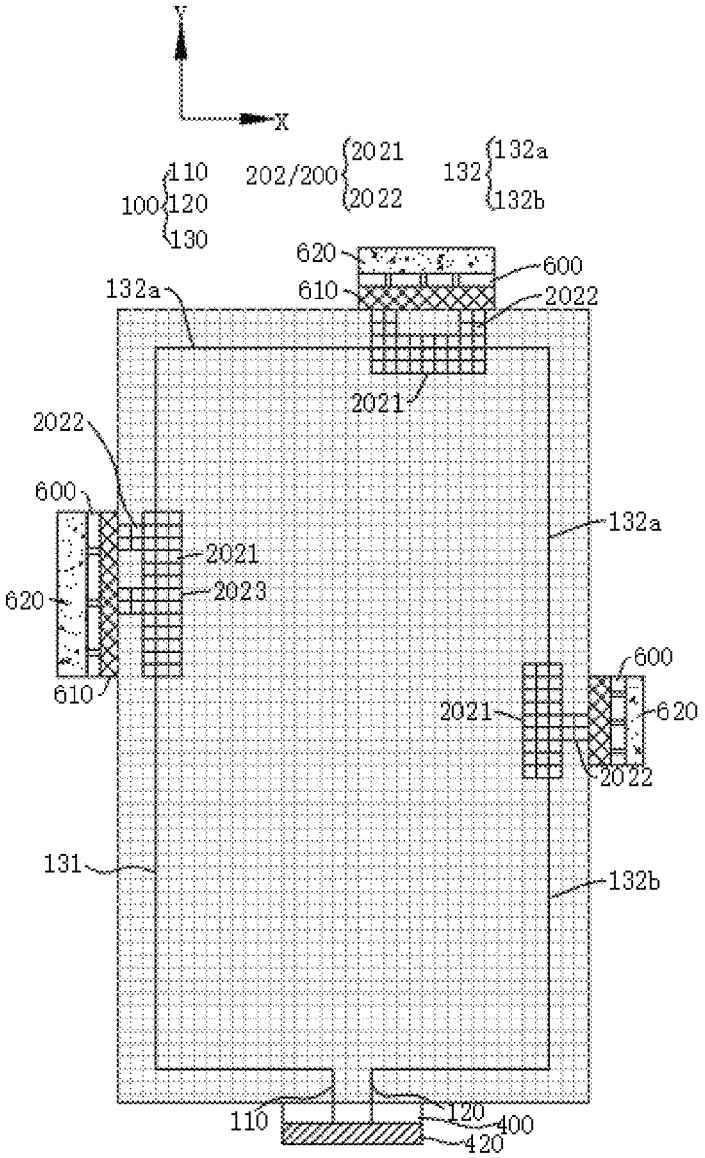
FIG. 2 is a schematic structural view of a wireless communication structure of a display panel according to a second embodiment of a first aspect of the present application.

Alternatively, reference is made to FIG. 2, which is a schematic structural view of a display panel according to a second embodiment of the first aspect. The structure of the embodiment illustrated in FIG. 2 is partially the same as the structure of the embodiment illustrated in FIG. 1, which will not be described in detail here, and differences therebetween will be described below. In addition, the following description herein will be directed to differences between various embodiments associated with respective drawings.

As shown in FIG. 2, a plurality of antennas 200 may be included, and the plurality of antennas 200 are arranged in a spaced manner on an extending path of the coil body 130.

The antenna 200 may be arranged in various manners. In some optional embodiments, with further reference to FIG. 1 and FIG. 2, the antenna 200 includes a non-millimeter-wave antenna 202. The non-millimeter-wave antenna 202 includes a non-millimeter-wave radiating portion 2021 and a non-millimeter-wave feeding portion 2022. The non-millimeter-wave radiating portion 2021 is connected to the coil body 130.

In these optional embodiments, the non-millimeter-wave radiating portion 2021 is connected to the coil body 130, and thus the non-millimeter-wave radiating portion 2021 and the coil body 130 are connected to each other, so that the number of cutting points of the mesh-shaped metal wires can be reduced. This can ensure a desired optical performance of the display screen and simplify patterning process of the antenna 200, thereby improving the manufacturing efficiency of the antenna 200 and reducing the manufacturing cost.

For example, frequencies of non-millimeter waves commonly used in mobile wireless communication are higher than 410 MHz and lower than 7.125 GHz, that is, the non-millimeter-wave antenna 202 refers to an antenna configured to transmit and/or receive wireless signals having frequencies higher than 410 MHz and lower than 7.125 GHz. The coil body 130 is configured to transmit wireless signals through coupling, and frequencies of wireless signals transmitted by the coil body 130 through coupling may be lower than 410 MHz.

Optionally, the non-millimeter-wave antenna 202 is an antenna configured for mobile wireless communication. The non-millimeter-wave antenna 202 herein generally refers to the non-millimeter-wave antenna 202 configured for mobile wireless communication and the non-millimeter-wave antenna 202 configured for mobile communication (including a cellular antenna, a WLAN antenna, a Bluetooth antenna, a GNSS antenna and the like for 5G and the previous generations).

Figure 3:
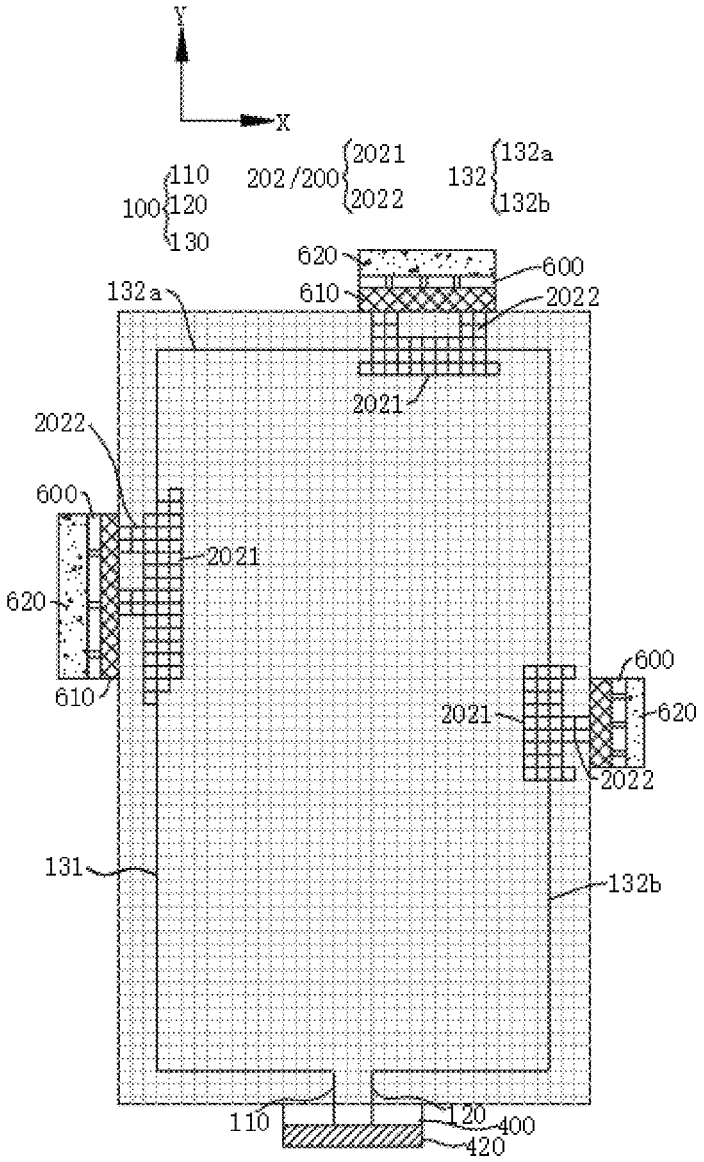
FIG. 3 is a schematic structural view of a wireless communication structure of a display panel according to a third embodiment of a first aspect of the present application.

Optionally, the non-millimeter-wave radiating portion 2021 may have various shapes. For example, as shown in FIG. 1 and FIG. 2, the non-millimeter-wave radiating portion 2021 is rectangular. In other embodiments, as shown in FIG. 3, the non-millimeter-wave radiating portion 2021 may be special shaped. When the non-millimeter-wave radiating portion is connected to the coil body 130, in order to control the influence of the loop structure 100 on the non-millimeter-wave antenna 202, various configurations may be used to block non-millimeter-wave currents on the loop structure 100.

An impedance of a conductor includes a resistance and a reactance.

Resistance=ρ (L/A), where p is a resistivity of the conductor, L is a length of the conductor, and A is a current distribution area corresponding to currents applied to the conductor. Given that intrinsic electrical and structural size parameters of the conductor are of constant values, when a signal frequency increases, a distribution area of a current in the conductor will decrease due to the skin effect (that is, the higher the frequency of the signal is, the more likely it is to concentrate the corresponding current on a thin layer near a surface of the conductor), that is, A will decrease, resulting in an increase in the resistance.

Since reactance=inductive reactance—capacitive reactance, the reactance and the inductive reactance are positively correlated. Inductive reactance=jwL, where w is an angular frequency and $w=2\pi f$, where f is a frequency, and L is an inductance; therefore, when the signal frequency increases, the inductive reactance increases. In addition, due to the skin effect mentioned above, an inductance corresponding to the high-frequency signal will also increase, which further increases the inductive reactance.

To sum up, when a frequency of a signal increases, flow of its corresponding current in the conductor will be blocked. Therefore, under same conductor conditions, a current corresponding to a high-frequency signal is more likely to be blocked than a current corresponding to a low-frequency signal. In addition, when a width of the conductor becomes smaller, the inductance of the conductor will increase, and therefore, the inductive reactance will further increase, so that flow of the current corresponding to the high-frequency signal will be further blocked. That is, by adjusting the size of the conductor, currents corresponding to different frequency signals can be desirably blocked or allowed to pass through.

When the loop structure 100 includes the NFC coil, a frequency band of wireless signals in millimeter-wave band transmitted and/or received by the millimeter-wave antenna unit 210 is higher than the NFC frequency band. Therefore, under same conductor conditions, the millimeter-wave currents corresponding to the frequencies of the wireless signals in the millimeter-wave band are more liable to be blocked and less liable to be allowed to pass through compared to the currents corresponding to the NFC frequency band. Therefore, by adjusting the size of the coil body 130, the millimeter-wave currents can be desirably blocked and the currents corresponding to the NFC frequency band can be desirably allowed to pass through.

When the loop structure 100 includes the NFC coil and the antenna 200 includes the non-millimeter-wave antenna 202, the frequencies of the wireless signals in the non-millimeter-wave band transmitted and/or received by the non-millimeter-wave antenna 202 are higher than the NFC frequency band. Therefore, under same conductor conditions, the non-millimeter-wave currents corresponding to the frequencies of the wireless signals in the non-millimeter-wave band are more liable to be blocked and less liable to be allowed to pass through compared to the currents corresponding to the NFC frequency band. Therefore, by adjusting the size of the coil body 130, the non-millimeter-wave currents can be desirably blocked and the currents corresponding to the NFC frequency band can be desirably allowed to pass through.

In some embodiments, as shown in FIG. 1 to FIG. 3, a width of at least a part of the non-millimeter-wave radiating portion 2021 is different from a line width of at least a part of the coil body 130, so that at least a part of the coil body 130 can allow the wireless signal currents transmitted and/or received by the loop structure 100 to pass through and block the non-millimeter-wave currents transmitted and/or received by the non-millimeter-wave antenna 202. The non-millimeter-wave currents refer to currents of the frequencies corresponding to wireless signals in non-millimeter-wave band transmitted and/or received by the non-millimeter-wave antenna 202, and wireless signal currents transmitted and/or received by the loop structure 100 refer to currents corresponding to the frequencies of wireless signals transmitted and/or received by the loop structure 100.

In these optional embodiments, the line width of at least a part of the non-millimeter-wave radiating portion 2021 is different from the line width of at least a part of the coil body 130, so that the currents for transmitting the signals of the frequency band corresponding to the non-millimeter-wave antenna 202 can pass through the non-millimeter-wave radiating portion 2021, but cannot pass through the coil body 130. Therefore, signal currents of the non-millimeter-wave antenna 202 and the loop structure 100 can be isolated from each other.

That is, in these embodiments, by appropriately configuring the line width of the coil body 130 and the line width of the non-millimeter-wave radiating portion 2021, the currents corresponding to the frequencies of wireless signals transmitted and/or received by the non-millimeter-wave antenna 202 and the loop structure 100 can be isolated from each other.

Optionally, a line width of at least a part of the coil body 130 is not greater than a line width of the non-millimeter-wave radiating portion 2021.

In these optional embodiments, because the line width of at least a part of the coil body 130 is relatively small, at least the part of the coil body 130 has a relatively high impedance. Therefore, at least the part of the coil body 130 has a desired filtering and blocking effect on the non-millimeter-wave currents transmitted and/or received by the non-millimeter-wave antenna 202. Therefore, in an embodiment of the present application, by configuring the line width of at least a part of the coil body 130 as being relatively small, currents of wireless signals transmitted and/or received by the non-millimeter-wave antenna 202 and the loop structure 100 can be isolated from each other.

Figure 4:
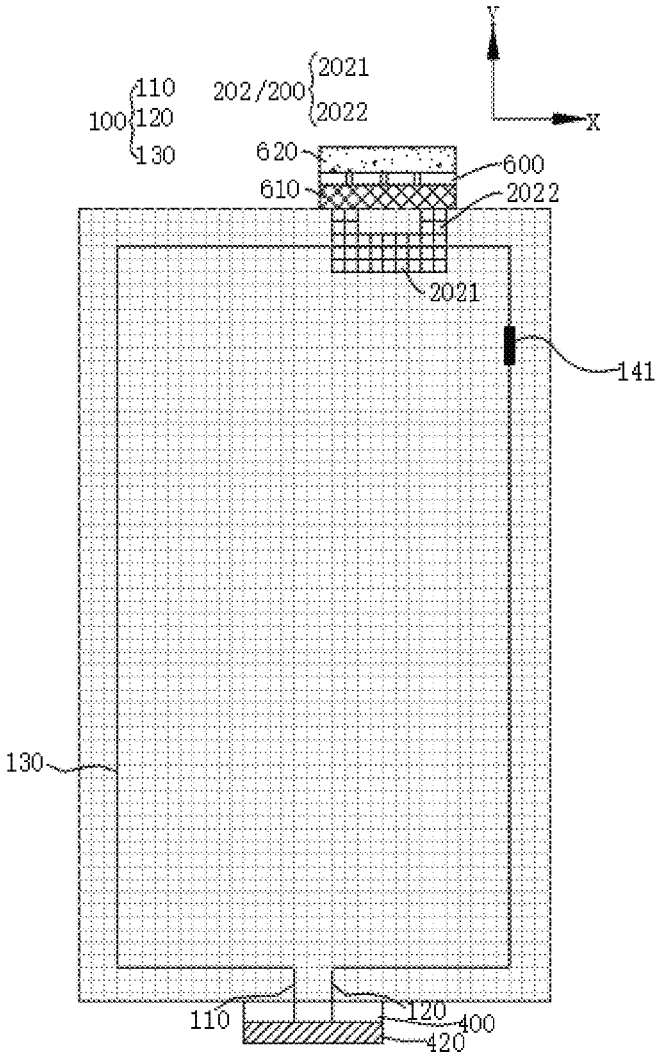
FIG. 4 is a schematic structural view of a wireless communication structure of a display panel according to a fourth embodiment of a first aspect of the present application.

In some other optional embodiments, as shown in FIG. 4, a first blocking portion 141 is arranged on the coil body 130. The first blocking portion 141 is configured to allow the wireless signal currents transmitted and/or received by the loop structure 100 to pass through, and block the non-millimeter-wave currents transmitted and/or received by the non-millimeter-wave antenna 202.

In an embodiment of the present application, by providing the coil body 130 with the first blocking portion 141, the wireless signal currents transmitted and/or received by the loop structure 100 can pass through the first blocking portion 141, and the non-millimeter-wave currents transmitted and/or received by the non-millimeter-wave antenna 202 are blocked by the first blocking portion 141, which can achieve the isolation between the wireless signal currents transmitted and/or received by the non-millimeter-wave antenna 202 and the loop structure 100.

In the embodiments mentioned above, when the first blocking portion 141 is configured to achieve the isolation between the currents transmitted and/or received by the non-millimeter-wave antenna 202 and the loop structure 100, optionally, as shown in FIG. 4, the number of the first blocking portion 141 may be one. One first blocking portion 141 may be arranged on a side of the non-millimeter-wave antenna 202 close to or away from the first connection end 110.

For example, as shown in FIG. 4, one first blocking portion 141 may be arranged between at least one non-millimeter-wave antenna 202 and the second connection end 120. In these optional embodiments, the currents of the non-millimeter-wave feeding portion 2022 may flow to the first blocking portion 141 or to the first connection end 110, so that the non-millimeter-wave antenna 202 can transmit and/or receive non-millimeter-wave wireless signals in various frequency bands.

Figure 5:
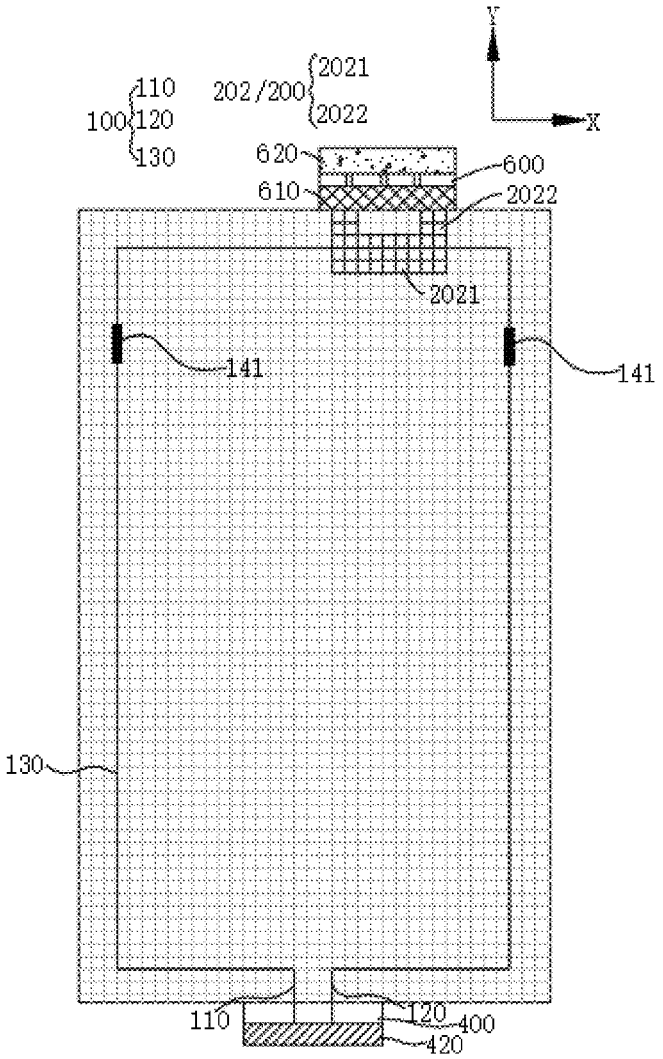
FIG. 5 is a schematic structural view of a wireless communication structure of a display panel according to a fifth embodiment of a first aspect of the present application.

Alternatively, in some other embodiments, as shown in FIG. 5, the number of the first blocking portions 141 may be two or more, and two or more first blocking portions 141 are arranged on both sides of the non-millimeter-wave antenna 202.

In these optional embodiments, two or more first blocking portions 141 include a first blocking portion 141*a* positioned on a side of the non-millimeter-wave antenna 202 close to the first connection end 110 and a first blocking portion 141*b* positioned on a side of the non-millimeter-wave antenna 202 away from the first connection end 110. The currents flowing out of the non-millimeter-wave feeding portion 2022 can flow to the first blocking portion 141*a* and the first blocking portion 141*b*, so that the non-millimeter-wave antenna 202 can transmit and/or receive the wireless signals in various frequency bands. In addition, by appropriately arranging the positions of the first blocking portion 141*a* and the first blocking portion 141*b*, the frequency band corresponding to the non-millimeter-wave antenna 202 can be controlled, so as to achieve the purpose of precisely controlling the frequency bands of wireless signals received by the non-millimeter-wave antenna 202.

Figure 6:
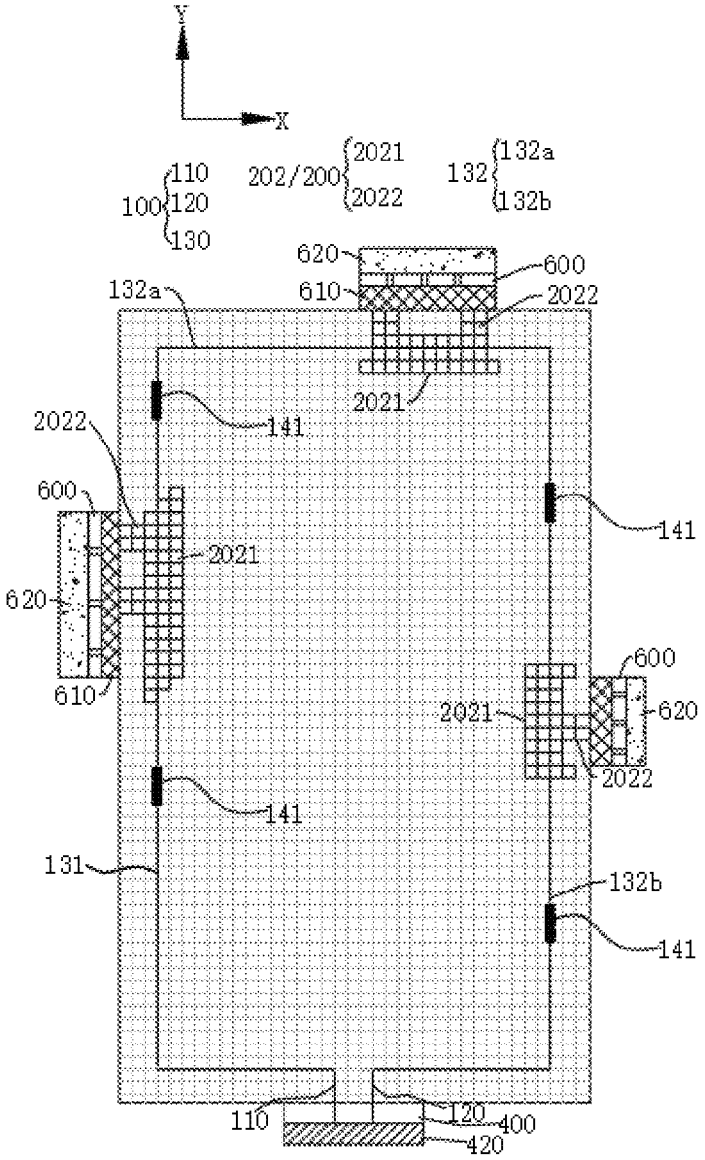
FIG. 6 is a schematic structural view of a wireless communication structure of a display panel according to a sixth embodiment of a first aspect of the present application.

In some optional embodiments, as shown in FIG. 6, the number of the non-millimeter-wave antennas 202 is two or more, and two or more non-millimeter-wave antennas 202 are arranged in a spaced manner on an extending path of the coil body 130.

When the number of the non-millimeter-wave antennas 202 is two or more, the number of the first blocking portions 141 may be one, two or more. The first blocking portion 141 may be arranged between the non-millimeter-wave antenna 202 and the first connection end 110 and/or between the non-millimeter-wave antenna 202 and the second connection end 120, the first blocking portion 141 may also be arranged between non-millimeter-wave radiating portions 2021 of two adjacent non-millimeter-wave antennas 202.

Optionally, in order to achieve the isolation of the wireless signal currents transmitted and/or received by the non-millimeter-wave antenna 202 and the loop structure 100, the line width of the first blocking portion 141 is different from the line width of the coil body 130, so that the wireless signal currents transmitted and/or received by the loop structure 100 can pass through the first blocking portion 141, but the non-millimeter-wave currents transmitted and/or received by the non-millimeter-wave antenna 202 cannot pass through the first blocking portion 141.

Figure 7:
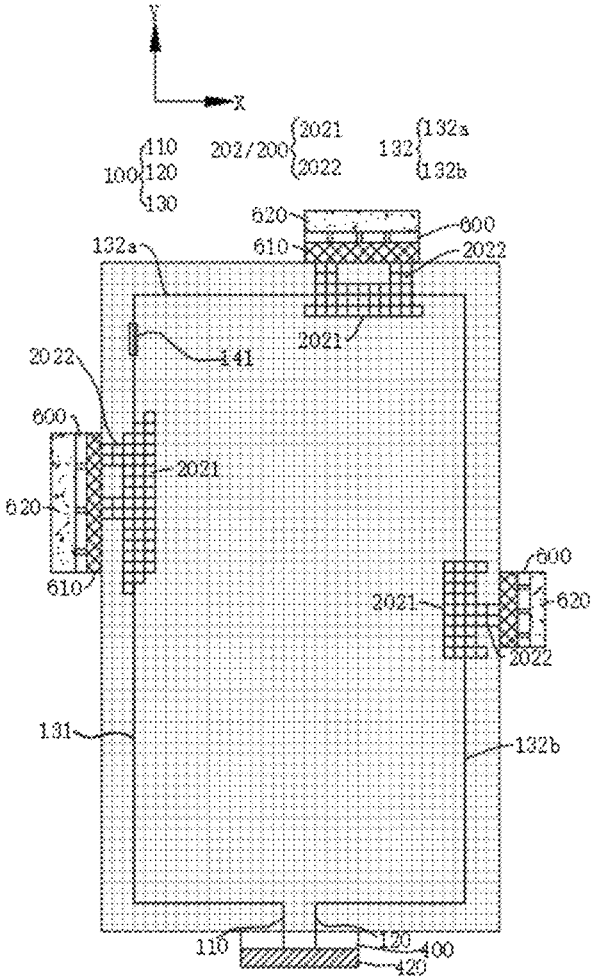
FIG. 7 is a schematic structural view of a wireless communication structure of a display panel according to a seventh embodiment of a first aspect of the present application.
Figure 8:
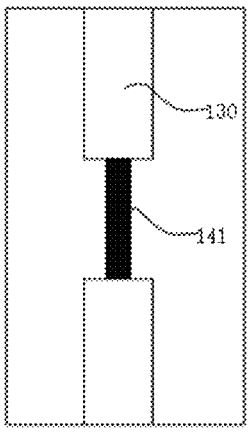
FIG. 8 is a partial magnified structural view of FIG. 7.

Optionally, as shown in FIG. 7 and FIG. 8, the non-millimeter-wave radiating portion 2021 includes a non-millimeter-wave wire, and the line width of the first blocking portion 141 is smaller than the width of the non-millimeter-wave wire in the non-millimeter-wave radiating portion 2021, so that the first blocking portion 141 can block the non-millimeter-wave currents transmitted and/or received by the non-millimeter-wave antenna 202. In these optional embodiments, the line width of the first blocking portion 141 is relatively small, so that the first blocking portion 141 has a relatively high impedance. Therefore, the first blocking portion 141 has a desired filtering and blocking effect on the non-millimeter-wave currents transmitted and/or received by the non-millimeter-wave antenna 202.

Figure 9:
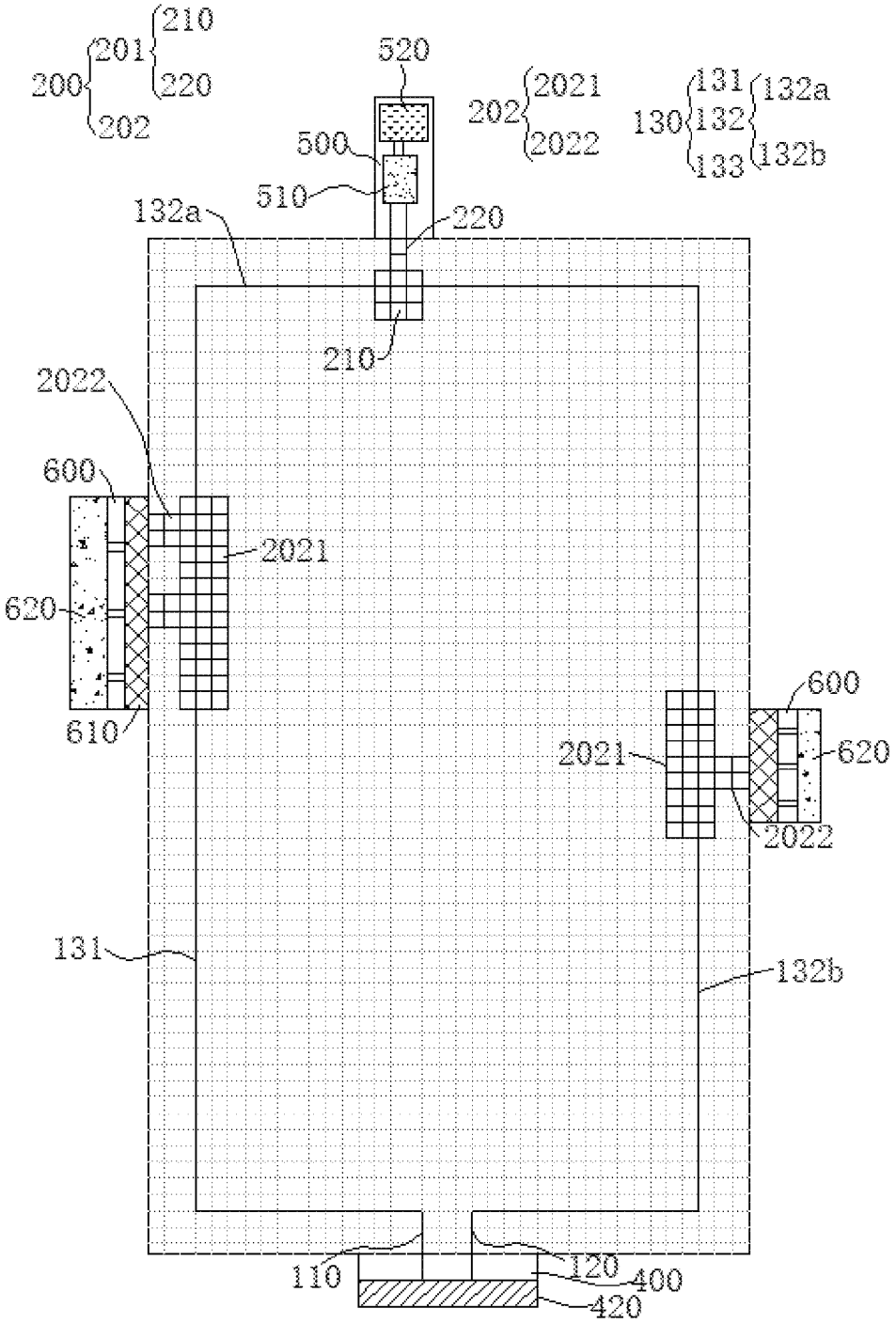
FIG. 9 is a schematic structural view of a wireless communication structure of a display panel according to an eighth embodiment of a first aspect of the present application.

With reference to FIG. 9, in some optional embodiments, the antenna 200 further includes a millimeter-wave antenna unit 210 connected to the coil body 130.

In these optional embodiments, the millimeter-wave antenna unit 210 is connected to the coil body 130, and the millimeter-wave antenna unit 210 and the coil body 130 are connected to each other. This can ensure a desired optical performance of the display screen and simplify patterning process of the antenna 200, thereby improving the manufacturing efficiency of the antenna 200 and reducing the manufacturing cost.

When the antenna 200 and the loop structure 100 are arranged in the touch layer 300, the millimeter-wave antenna unit 210 and the coil body 130 are connected to each other, which can reduce the cutting points of the mesh-shaped metal wiring and ensure a desired touch effect of the touch layer 300 at the same time.

Optionally, the millimeter-wave antenna unit 210 may have various shapes, for example, the shape of the millimeter-wave antenna unit 210 may be a square, a diamond, or the like.

Figure 10:
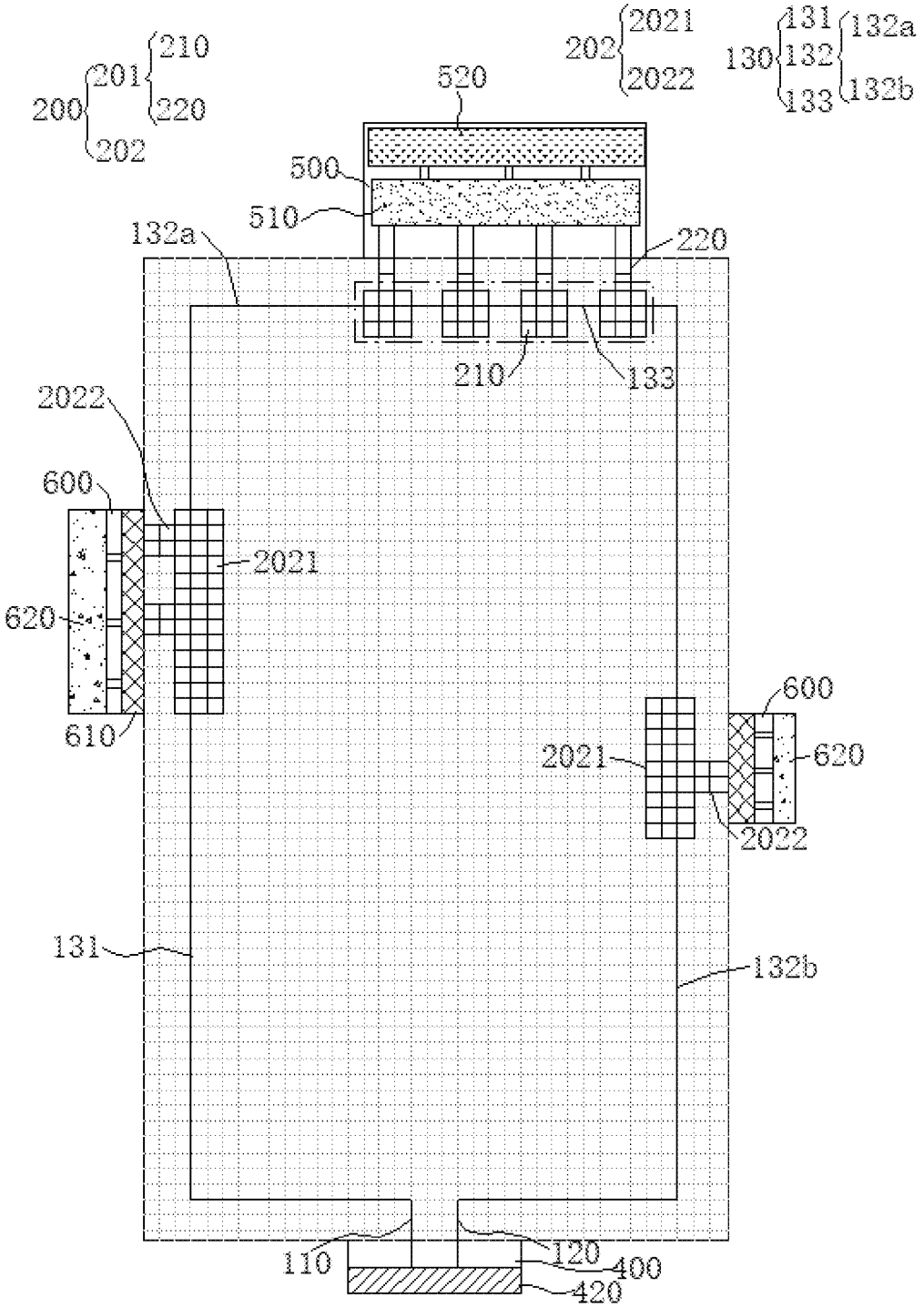
FIG. 10 is a schematic structural view of a wireless communication structure of a display panel according to a ninth embodiment of a first aspect of the present application.

Optionally, with reference to FIG. 10, two or more millimeter-wave-antenna units 210 form a millimeter-wave antenna array 201 in combination. In an embodiment of the present application, the number of millimeter-wave antenna units 210 is two or more, and two or more millimeter-wave antenna units 210 are arranged adjacently or in an array to form the millimeter-wave antenna array 201, which can improve the antenna gain and compensate for the large radiation path loss, and can achieve the effect of beam scanning to cover a wide space to reduce the wireless communication blind areas and achieve a desired user wireless experience.

Optionally, transmission frequencies of the millimeter-wave antenna array 201 are different form the transmission frequencies of non-millimeter-wave antenna 202. For example, frequencies of millimeter waves commonly used in the mobile wireless communication are higher than 24.25 GHz, that is, the millimeter-wave antenna array 201 refers to an antenna array that transmits and/or receives wireless signals with frequencies higher than 24.25 GHz.

Optionally, the millimeter-wave antenna array 201 and the non-millimeter-wave antenna 202 are antennas configured for mobile wireless communication.

When the antenna 200 of the wireless communication structure includes the millimeter-wave antenna array 201 and the non-millimeter-wave antennas 202, the millimeter-wave antenna array 201 and the non-millimeter-wave antennas 202 may be arranged in various manners.

Optionally, the coil body 130 includes a first connection segment 131 and a second connection segment 132. The first connection segment 131 is connected between the first connection end 110 and the antenna 200. The second connection segment 132 is connected between the second connection end 120 and the antenna 200. When two or more millimeter-wave antenna units 210 form the millimeter-wave antenna array 201 in combination, the coil body 130 further includes a third connection segment 133. The third connection segment 133 is connected between two adjacent millimeter-wave antenna units 210 in a same millimeter-wave antenna array 201.

The first connection segment 131, the second connection segment 132 and the third connection segment 133 may be arranged in various manners. For example, the first connection segment 131 may include one wire, or the first connection segment 131 may include multiple wires arranged side by side, or the first connection segment 131 may include multiple wires arranged side by side and bridge wires connecting the wires arranged side by side. Likewise, the second connection segment 132 and/or the third connection segment 133 may include a wire, or the second connection segment 132 and/or the third connection segment 133 may include multiple wires arranged side by side, or the second connection segment 132 and/or the third connection segment 133 may include multiple wires arranged side by side and bridge wires connecting the wires arranged side by side.

In some optional embodiments, as shown in FIG. 10, the millimeter-wave antenna unit 210 and the non-millimeter-wave radiating portion 2021 are spaced apart from each other on the extending path of the coil body 130, to avoid a significant degradation of wireless communication quality because of the antennas being blocked (for example, by a human hand, a human head and metals, etc.) at the same time. This can also increase the spatial coverage of the antenna radiation beams, which reduces wireless communication blind areas. In addition, the mutual negative influences between the millimeter-wave antenna array 201 and the non-millimeter-wave antenna 202 or between multiple non-millimeter-wave antennas can be reduced to improve the quality of wireless communication.

When the loop structure 100 includes the NFC coil and the antenna 200 includes non-millimeter-wave antenna 202 and a millimeter-wave antenna array 201, the frequencies of the millimeter-wave wireless signals transmitted and/or received by the millimeter-wave antenna array 201 are higher than the frequencies of the non-millimeter-wave wireless signals transmitted and/or received by the non-millimeter-wave antenna 202, and the frequencies of the non-millimeter-wave wireless signals transmitted and/or received by the non-millimeter-wave antenna 202 are higher than the NFC frequency band. Therefore, under same conductor conditions, the millimeter-wave currents corresponding to the frequencies of the millimeter-wave wireless signals are more liable to be blocked and less liable to pass through compared to the currents corresponding to the frequencies of the non-millimeter-wave wireless signals, and the non-millimeter-wave currents corresponding to the frequencies of the non-millimeter-wave wireless signals are more liable to be blocked and less liable to pass through compared to the currents corresponding to the NFC frequency band. Therefore, by adjusting the size of the coil body 130, the millimeter-wave currents can be desirably blocked and the non-millimeter-wave currents and the currents corresponding to the NFC frequency band can desirably pass through, or, by adjusting the size of the coil body 130, the millimeter-wave currents and the non-millimeter-wave currents can be desirably blocked, and the currents corresponding to the NFC frequency band can desirably pass through.

When the millimeter-wave antenna unit 210 and the non-millimeter-wave radiating portion 2021 are arranged on the coil body 130 in a spaced manner, the currents of wireless signals transmitted and/or received by the millimeter-wave antenna array 201 and the non-millimeter-wave antennas 202 can be isolated through various manners.

Optionally, the line width of at least a part of the coil body 130 is not greater than the width of the millimeter-wave antenna unit 210. That is, the line width of at least a part of the coil body 130 is relatively small and the impedance of at least a part of the coil body 130 is relatively high. The millimeter-wave currents can be desirably blocked, so that the coil body 130 may have a desired filtering and blocking effect on the millimeter-wave currents transmitted and/or received by the millimeter-wave antenna array 201 to ensure a desired performance of the millimeter-wave antenna array 201. That is, in an embodiment, by appropriately designing the line width of the coil body 130, the coil body 130 can block the millimeter-wave currents.

Optionally, the line width of the first connection segment 131 is not greater than the sum of the line widths of millimeter-wave wires in the millimeter-wave antenna unit 210. As shown in FIG. 9 to FIG. 10, when the first connection segment 131 extends along a first direction X, the width direction of the first connection segment 131 and the millimeter-wave wire is a second direction Y; and when the first connection segment 131 extends along the second direction Y, the width direction of the first connection segment 131 and the millimeter-wave wire is the first direction X.

In an embodiment of the present application, the line width of the first connection segment 131 is relatively small, so that the first connection segment 131 has a relatively high impedance. Therefore, the first connection segment 131 may have a desired filtering and blocking effect on the non-millimeter-wave currents and the millimeter-wave currents. However, the first connection segment 131 has a desired passing effect on the currents of the NFC frequency band. Therefore, in an embodiment of the present application, the currents of the loop structure 100 can desirably pass through the first connection segment 131, but the non-millimeter-wave currents and the millimeter-wave currents are significantly blocked by the first connection segment 131.

Optionally, the line width of the first connection segment 132 is not greater than the sum of the line widths of the millimeter-wave wires in the millimeter-wave antenna units 210. As shown in FIG. 9 to FIG. 10, when the second connection segment 132 extends along the first direction X, the width direction of the second connection segment 132 and the millimeter-wave wire is the second direction Y; when the second connection segment 132 extends along the second direction Y, the width direction of the second connection segment 132 and the millimeter-wave wire is the first direction X.

As mentioned above, the line width of the second connection segment 132 is relatively small, so that the millimeter-wave currents can be desirably blocked and the non-millimeter-wave currents can desirably pass through, that is, the blocking of the millimeter-wave currents can be desirably achieved by the second connection segment 132, which can ensure a desired performance of the millimeter-wave antenna array 201 and the millimeter-wave antenna unit 210, and does not significantly affect other non-millimeter-wave currents and the currents of the NFC frequency band.

Figure 12:
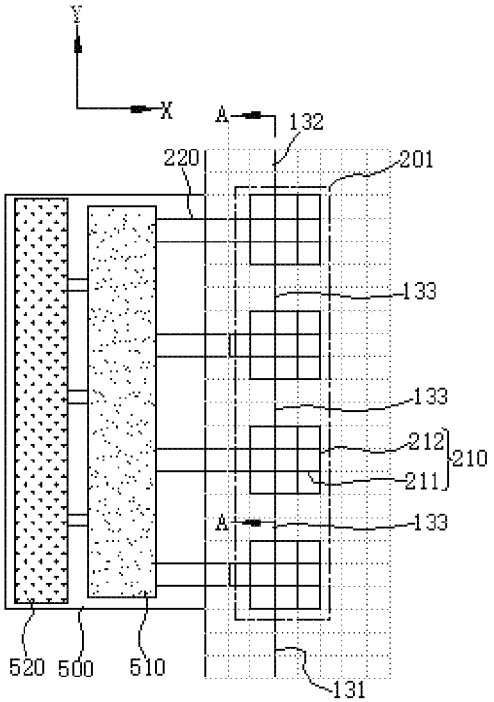
FIG. 12 is a partial magnified structural view of FIG. 11.
Figure 13:
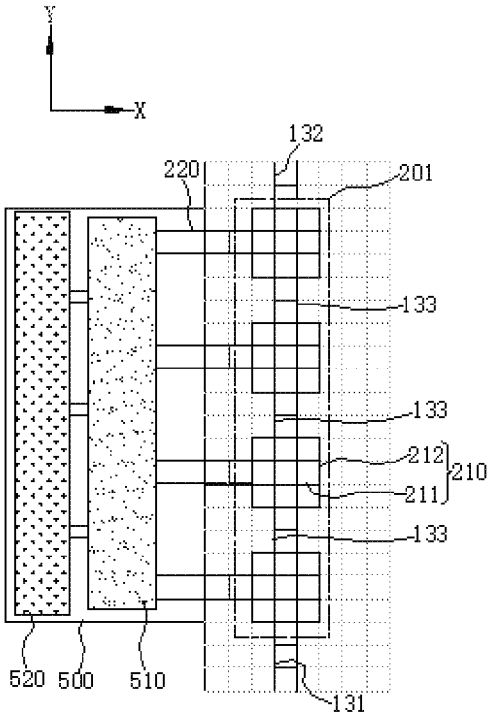
FIG. 13 is a partial magnified structural view of FIG. 11 in an eleventh embodiment.

The number of the third connection segments 133 may be set in various manners. As shown in FIG. 12, the third connection segment 133 between two adjacent millimeter-wave antenna units 210 may include one wire. Alternatively, as shown in FIG. 13, the third connection segment 133 between two adjacent millimeter-wave antenna units 210 may include two or more wires.

Optionally, as shown in FIG. 12, when the third connection segment 133 between two adjacent millimeter-wave antenna units 210 include one wire, the line width of one wire in the third connection segments 133 is not greater than the sum of the line widths of the millimeter-wave wires in the millimeter-wave antenna unit 210. As shown in FIG. 13, when the third connection segment 133 between two adjacent millimeter-wave antenna units 210 include two or more wires, the sum of the line widths of two or more wires in the third connection segment 133 is not greater than the sum of the line widths of the millimeter-wave wires in the millimeter-wave antenna unit 210. As shown in FIG. 12 and FIG. 13, when the first direction X is perpendicular to the second direction Y, the third connection segment 133 extends along the second direction Y, and the width direction of the third connection segment 133 and the millimeter-wave wire is the first direction X. In some other embodiments, when the third connection segment 133 extends along the first direction X, the width direction of the third connection segment 133 and the millimeter-wave wire is the second direction Y.

Figure 14:
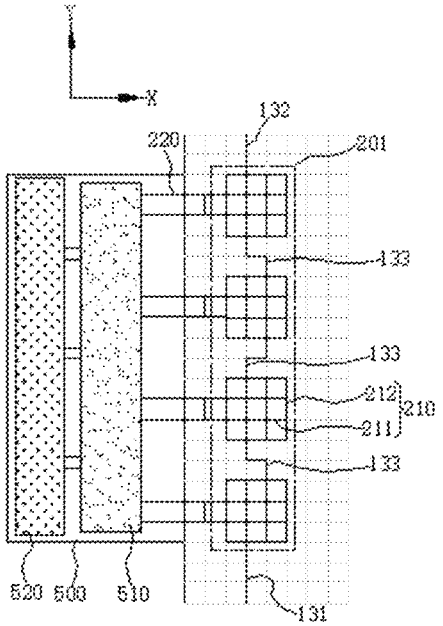
FIG. 14 is a partial magnified structural view of FIG. 11 in a twelfth embodiment.

In an embodiment of the present application, the line width of the third connection segment 133 is relatively small, so that the third connection segments 133 have a relatively high impedance. Therefore, the third connection segments 133 may have a desired filtering and blocking effect on the millimeter-wave currents. However, the third connection segment 133 can have a desired passing effect on non-millimeter-wave frequencies of mobile communication in 5G and the previous generations, WLAN or BT and the like, and the currents of the NFC frequency band and the like. The third connection segment 133 may have various shapes, as shown in FIG. 12 and FIG. 13, the shape of the third connection segment 133 may be a straight line, that is, the third connection segment 133 extends along one direction. Alternatively, as shown in FIG. 14, the third connection segment 133 may be in the shape of a folded line, that is, the third connection segment 133 extends along a bending path. Alternatively, the third connection segment 133 may be in the shape of an arc. Alternatively, the third connection segment 133 are formed by a combination of at least two of a straight line, a folded line, and an arc.

Alternatively, a line width of at least a part of the coil body 130 is not greater than a line width of the non-millimeter-wave radiating portion 2021. That is, the line width of at least a part of at least one of the first connection segment 131, the second connection segment 132 and the third connection segments 133 is not greater than the width of the non-millimeter-wave radiating portion 2021. Optionally, the line width of at least a part of at least one of the first connection segment 131, the second connection segment 132 and the third connection segments 133 is not greater than the width of the non-millimeter-wave wire in the non-millimeter-wave radiating portion 2021.

For example, the line width of at least a part of the first connection segment 131 is not greater than the width of the non-millimeter-wave radiating portion 2021. When the non-millimeter-wave radiating portion 2021 is in the shape of block, the non-millimeter-wave radiating portion 2021 can be understood as including one non-millimeter-wave wire. When the non-millimeter-wave radiating portion 2021 include multiple non-millimeter-wave wires, that the line width of at least a part of the first connection segment 131 is not greater than the width of the non-millimeter-wave radiating portion 2021 means that the line width of at least a part of the first connection segment 131 is not greater than the sum of the widths of the multiple non-millimeter-wave wires in the non-millimeter-wave radiating portion 2021.

Optionally, the line widths of the first connection segment 131, the second connection segment 132 and the third connection segments133 are each set to be not greater than the line width of the non-millimeter-wave wire. In this way, the non-millimeter-wave currents can be significantly blocked by the first connection segment 131, the second connection segment 132 and the third connection segment 133, so that the independence of each non-millimeter-wave radiating portion 2021 in the millimeter-wave antenna array 201 can be desirably ensured, thereby ensuring the performance of the millimeter-wave antenna array 201.

Optionally, at least one of the first connection segment 131, the second connection segment 132 and the third connection segments 133 can block the non-millimeter-wave currents. At least one of the first connection segment 131, the second connection segment 132 and the third connection segments 133 can block the millimeter-wave currents. So that neither the non-millimeter-wave currents nor the millimeter-wave currents can pass through at least a part of the coil body 130. Even when the millimeter-wave antenna array 201 and the non-millimeter-wave radiating portion 2021 of the non-millimeter-wave antenna 202 are both connected to the coil body 130, the wireless signal currents of the non-millimeter-wave antenna 202 and the millimeter-wave antenna array 201 can be blocked on the loop structure 100, so that a desired performance of the non-millimeter-wave antenna 202 and the millimeter-wave antenna array 201 can be designed and ensured.

Figure 11:
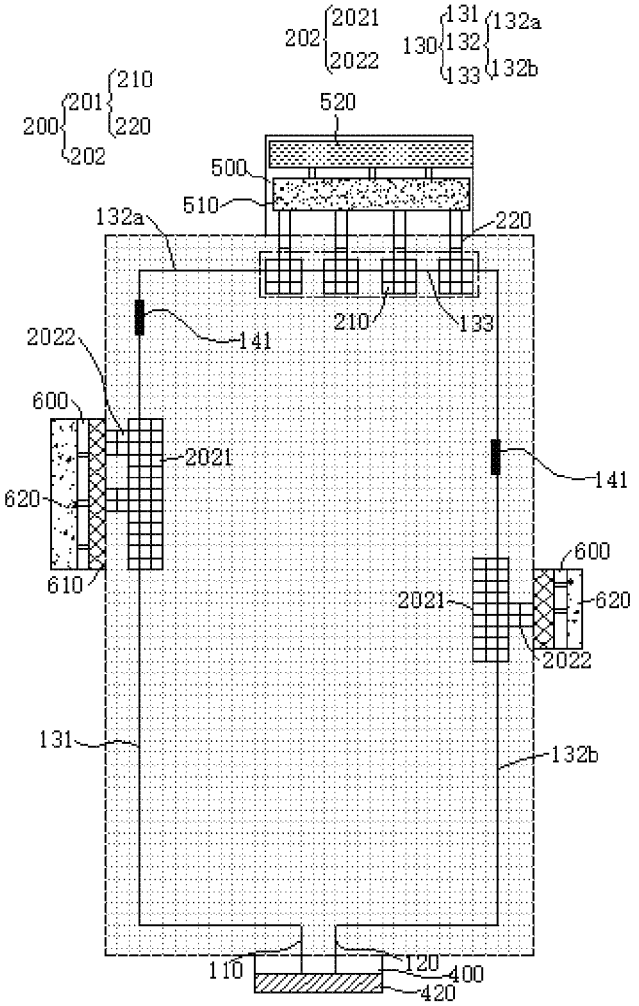
FIG. 11 is a schematic structural view of a wireless communication structure of a display panel according to a tenth embodiment of a first aspect of the present application.

In some optional embodiments, with further reference to FIG. 11, the millimeter-wave antenna unit 210 and the non-millimeter-wave radiating portion 2021 may be arranged on the coil body 130 in a spaced manner. The first blocking portion 141 are arranged on the coil body 130, to block the non-millimeter-wave currents and the millimeter-wave currents in the coil body 130.

Figure 15:
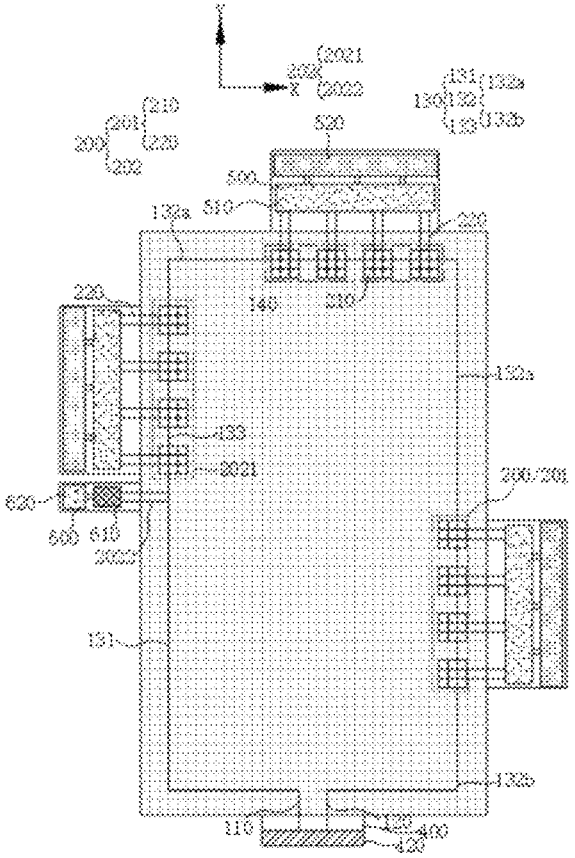
FIG. 15 is a schematic structural view of a wireless communication structure of a display panel according to a thirteenth embodiment of a first aspect of the present application.

Optionally, with reference to FIG. 15, the number of antennas 200 is two or more, and the first connection segment 131 is connected between one of the antennas 200 (for example, the non-millimeter-wave antenna 202) and the first connection end 110. The second connection segment 132 includes a first sub-segment 132*a* and a second sub-segment 132*b*. The first sub-segment 132*a* is connected between two adjacent antennas 200 (for example, the first sub-segment 132*a* is connected between the adjacent non-millimeter-wave antenna 202 and the millimeter-wave antenna array 201). The second sub-segment 132*b* is connected between another antenna 200 (for example, the millimeter-wave antenna array 201) and the second connection end 120. The first sub-segment 132*a* is configured to implement the connection between two adjacent antennas 200, and the second sub-segment 132*b* is configured to implement the connection between the antenna 200 and the second connection end 120. That is, the second connection segment 132 is divided into multiple segments, and part of the second connection segment 132 (for example, the first sub-segment 132*a*) is configured to implement the connection between two adjacent antennas 200, and part of the second connection segment 132 (for example, the second sub-segment 132*b*) is configured to implement the connection between the antenna 200 and the second connection end 120.

As shown in FIG. 15, the antennas 200 can be divided into three groups. Two of the three groups of antennas 200 are arranged opposite to each other along the first direction X, that is, the two groups of antennas 200 are arranged on edges of two opposite sides of the display panel along the first direction X, respectively (the two groups of antennas 200 are not necessarily on exactly the same position relative to the respective edges of the display panel). Another one of the three groups of antennas 200 are arranged opposite to the first connection end 110 and the second connection end 120 along the second direction Y, so that the first connection end 110, the second connection end 120 and the three groups of antennas 200 are distributed around the periphery of the display panel in a spaced manner, and the antennas 200 are distributed at different positions of the display panel. When a user uses different gestures to operate the display panel, there can always be at least one antenna 200 in a position that is not blocked by the user, so the stability of the antennas 200 for transmitting and/or receiving the wireless signals can be improved, and a desired user's wireless experience can be ensured.

Figure 16:
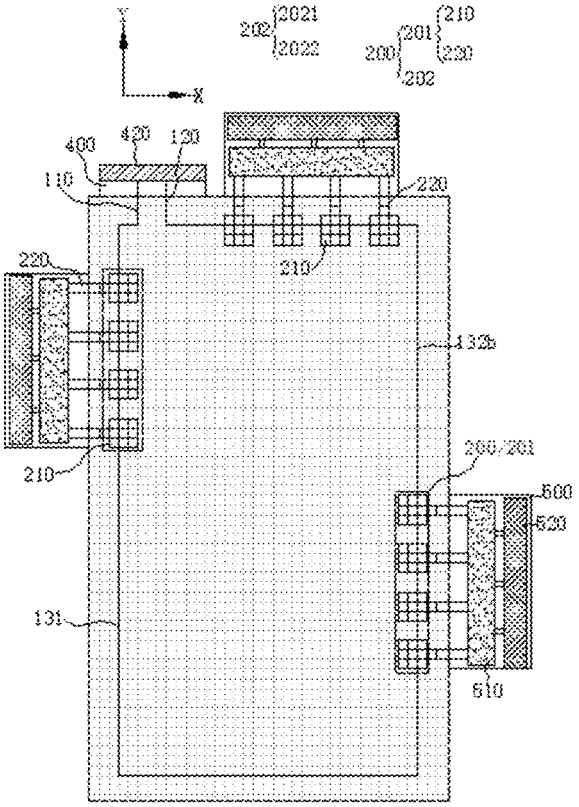
FIG. 16 is a schematic structural view of a wireless communication structure of a display panel according to a fourteenth embodiment of a first aspect of the present application.

In some other optional embodiments, as shown in FIG. 16, the first connection end 110, the second connection end 120, and the antennas 200 may be arranged along the first direction X in a spaced manner. That is the first connection end 110 and the second connection end 120 are arranged by the side of one of the antennas 200.

In still some other embodiments, with further reference to FIG. 15, when the antenna 200 of the wireless communication structure include the millimeter-wave antenna unit 210 and the non-millimeter-wave antenna 202, at least one millimeter-wave antenna unit 210 is reused as at least a part of the non-millimeter-wave radiating portion 2021.

In these optional embodiments, wiring structure of the wireless communication structure can be further simplified, and when the wireless communication structure is arranged in the display panel, the display effect of the display panel can be improved. Additionally, at least one millimeter-wave antenna unit 210 and at least a part of the non-millimeter-wave radiating portion 2021 may be reused as each other, which can reduce the distribution area of the wireless communication structure, so that more antennas 200 can be arranged in a small space.

That at least one millimeter-wave antenna unit 210 is reused as at least a part of the non-millimeter-wave radiating portion 2021 may means that one millimeter-wave antenna unit 210 is reused as at least a part of the non-millimeter-wave radiating portion 2021, or at least two adjacent millimeter-wave antenna units 210 are connected by the third connection segment 133 and reused as at least a part of the non-millimeter-wave radiating portion 2021. That at least two adjacent millimeter-wave antenna units 210 are connected by the third connection segment 133 and reused as at least a part of the non-millimeter-wave antenna 202 means that at least two adjacent millimeter-wave antenna units 210, when connected by the third connection segment 133, can have the function of the non-millimeter-wave radiating portion 2021 and be configured to transmit and/or receive the non-millimeter-wave wireless signals.

When at least one millimeter-wave antenna unit 210 is reused at least a part of the non-millimeter-wave radiating portion 2021, the at least one millimeter-wave antenna unit 210 can be connected to the non-millimeter-wave feeding portion 2022, for example, the at least one millimeter-wave antenna unit 210 can be connected to the non-millimeter-wave feeding portion 2022 by a part of the coil body 130. So that the at least two adjacent millimeter-wave antenna units 210 are able to be connected to a radio frequency integrated circuit of the non-millimeter-wave antenna 202, the function of the non-millimeter-wave antenna 202 can be achieved.

When at least two adjacent millimeter-wave antenna units 210 are connected by the third connection segment 133 and reused as at least a part of the non-millimeter-wave radiating portion 2021, at least two adjacent millimeter-wave antenna units 210 may be connected in series or in parallel with each other and reused as at least a part of the non-millimeter-wave radiating portion 2021.

In these optional embodiments, the reusing of at least a part of the non-millimeter-wave antenna 202, at least a part of the millimeter-wave antenna array 201 and at least a part of the loop structure 100 can further reduce the area occupied by the various type of antennas 200 and simplify disposition pattern of the various types of antennas 200. Therefore, the cutting points of mesh-shaped metal wiring can be reduced, and desired display performance and touch performance of the display panel can be ensured.

When at least one millimeter-wave antenna unit 210 and at least a part of the non-millimeter-wave radiating portion 2021 are reused as each other, the non-millimeter-wave radiating portion 2021 and the non-millimeter-wave feeding portion 2022 may be connected to each other in various manners.

Figure 17:
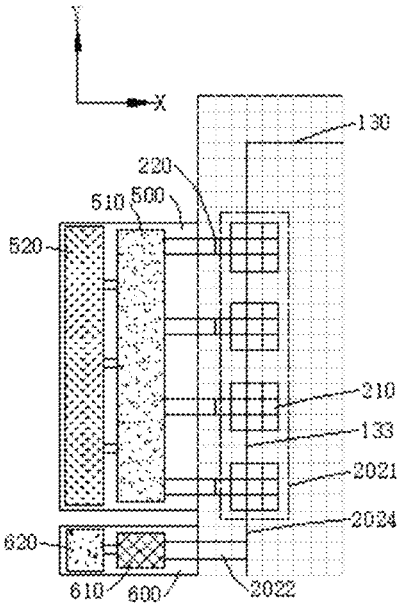
FIG. 17 is a partial magnified structural view of FIG. 11 in a fifteenth embodiment.

In some optional embodiments, as shown in FIG. 17, the non-millimeter-wave radiating portion 2021 includes a first connection wire 2024 connecting the non-millimeter-wave feeding portion 2022 and the millimeter-wave antenna unit 210, and the first connection wire 2024 is part of the coil body 130. That is, the non-millimeter-wave feeding portion 2022 and the non-millimeter-wave radiating portion 2021 are connected to each other by using part of the coil body 130. The first connection wire 2024 may include one or multiple wires.

Optionally, the coil body 130 is divided into a first connection segment 131, a second connection segment 132 and third connection segment 133. The first connection segment 131 is positioned between the millimeter-wave antenna unit 210 and the first connection end 110. As shown in FIG. 17, when the non-millimeter-wave radiating portion 2021 is positioned on a side of the millimeter-wave antenna unit 210 close to the first connection end 110, the first connection wire 2024 may be part of the first connection segment 131. In other embodiments, the second connection segment 132 is positioned between the millimeter-wave antenna unit 210 and the second connection end 120, when the non-millimeter-wave radiating portion 2021 is positioned on a side of the millimeter-wave antenna unit 210 close to the second connection end 120, the first connection wire 2024 may be part of the second connection segment 132.

Figure 18:
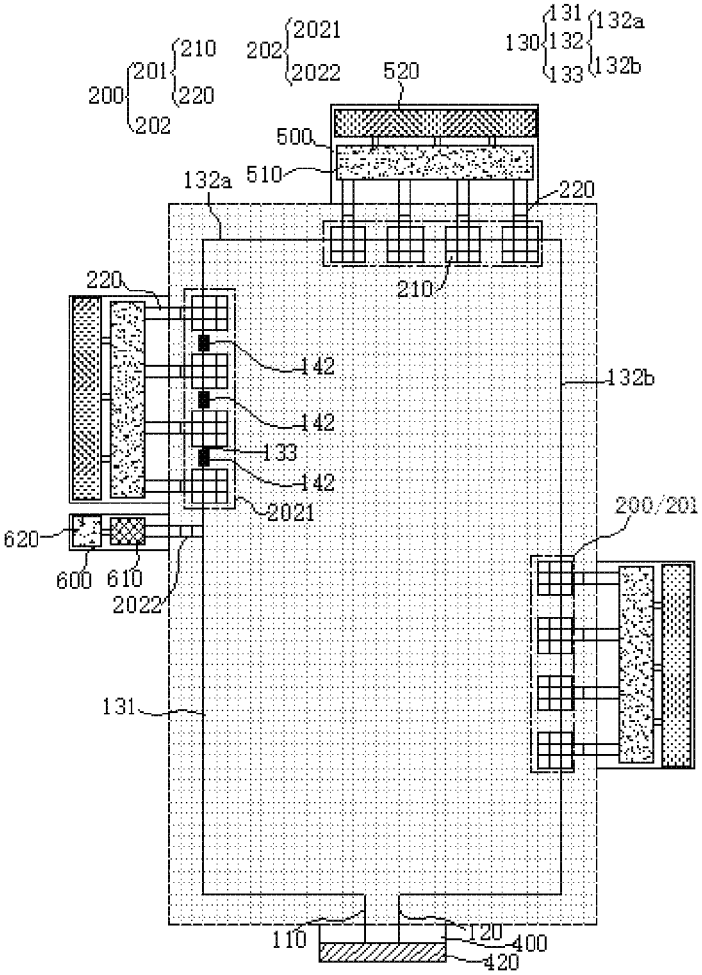
FIG. 18 is a schematic structural view of a wireless communication structure of a display panel according to a sixteenth embodiment of a first aspect of the present application.

Optionally, as shown in FIG. 18, second blocking portions 142 are arranged on the coil body 130 and configured to allowed the wireless signal currents transmitted and/or received by the loop structure 100 and the non-millimeter-wave currents of the wireless signals transmitted and/or received by the non-millimeter-wave antennas 202 to pass through, and block the millimeter-wave currents transmitted and/or received by the millimeter-wave antenna unit 210, and the line width of the second blocking portion 142 is greater than the line width of the first blocking portion 141.

In these optional embodiments, by arranging the second blocking portion 142 on the coil body 130, millimeter-wave currents can be desirably blocked, and a desired performance of the millimeter-wave antenna unit 210 can be designed and ensured.

In addition, non-millimeter-wave currents can pass through the second blocking portion 142. As shown in FIG. 18, when two millimeter-wave antenna units 210 are reused as at least part of the non-millimeter-wave radiating portion 2021, a second blocking portion 142 is arranged between two millimeter-wave antenna units 210, where the second blocking portion 142 does not block non-millimeter-wave currents.

The second blocking portion 142 may be configured in various manners. For example, the second blocking portion 142 may be configured by changing the width of at least part of the coil body 130 (that is, by changing the thickness of the coil body 130), to achieve the goal of blocking millimeter-wave currents. The user can configure the position, width, length, shape, layer numbers and the number of the second blocking portions 142 according to the frequencies of the wireless signals in the non-millimeter-wave band transmitted and/or received by the non-millimeter-wave antennas 202 and the frequencies of the wireless signals transmitted and/or received by the loop structure 100 in actual use, to block the millimeter-wave currents, thus achieving the design of targeted operating frequency of the millimeter waves.

Optionally, as shown in FIG. 18, in order to illustrate the positions of the second blocking portions 142 more clearly, the width of the second blocking portion 142 is set to be greater than the width of the coil body 130.

The second blocking portion 142 may be arranged in various positions. Optionally, the number of the second blocking portions 142 is two or more, and two or more second blocking portions 142 are positioned on both sides of the millimeter-wave antenna unit 210 to block millimeter-wave currents, thus implementing the design of the targeted operating frequency of the millimeter waves.

Optionally, when two or more millimeter-wave antenna units 210 form the millimeter-wave antenna array 201 in combination, each millimeter-wave antenna unit 210 in the millimeter-wave antenna array 201 is connected to the coil body 130.

When the first blocking portion 141 and the second blocking portion 142 are arranged on the coil body 130, the first blocking portion 141 and the second blocking portion 142 may be arranged in various positions. For example, the first blocking portion 141 and/or the second blocking portion 142 may be arranged between adjacent millimeter-wave antenna units 210 in the same millimeter-wave antenna array 201.

The first blocking portion 141 and the second blocking portion 142 may be arranged on any one of the first connection segment 131, the second connection segment 132 and the third connection segment 133.

Figure 19:
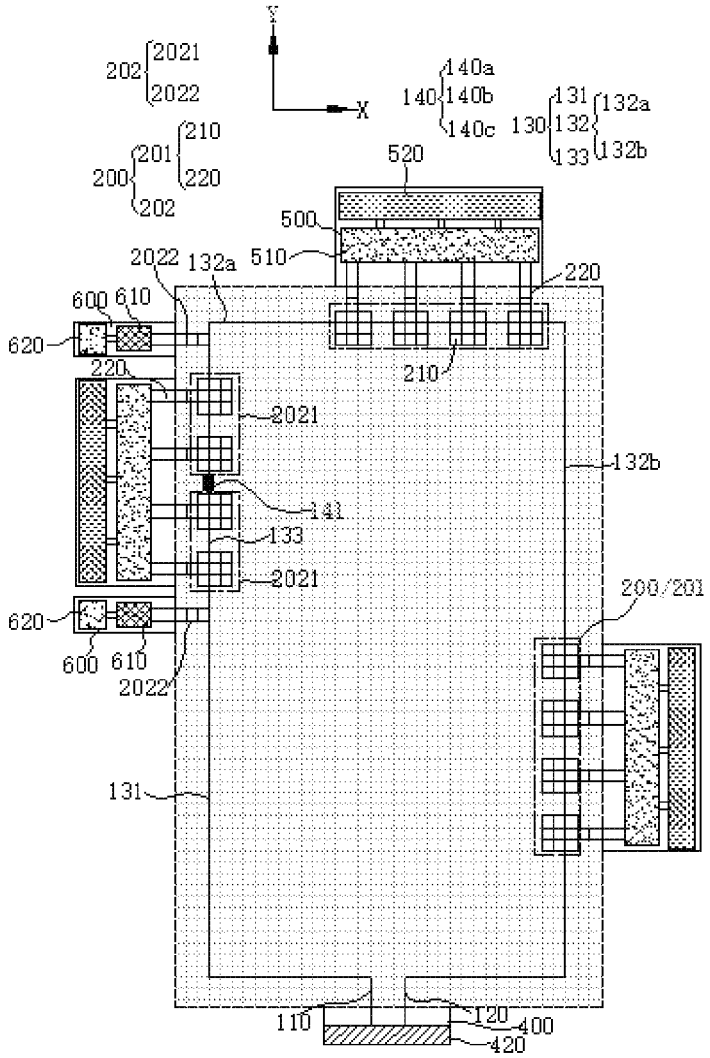
FIG. 19 is a schematic structural view of a wireless communication structure of a display panel according to a seventeenth embodiment of a first aspect of the present application.

In some other optional embodiments, as shown in FIG. 19, the first blocking portion 141 may be arranged on the third connection segment 133. Optionally, two or more millimeter-wave antenna units 210 in a same millimeter-wave antenna array 201 are divided into two or more groups, the millimeter-wave antenna units 210 in each group are reused as one non-millimeter-wave antenna 202, and the first blocking portion 141 is arranged between two adjacent groups of millimeter-wave antenna units 210.

Figure 20:
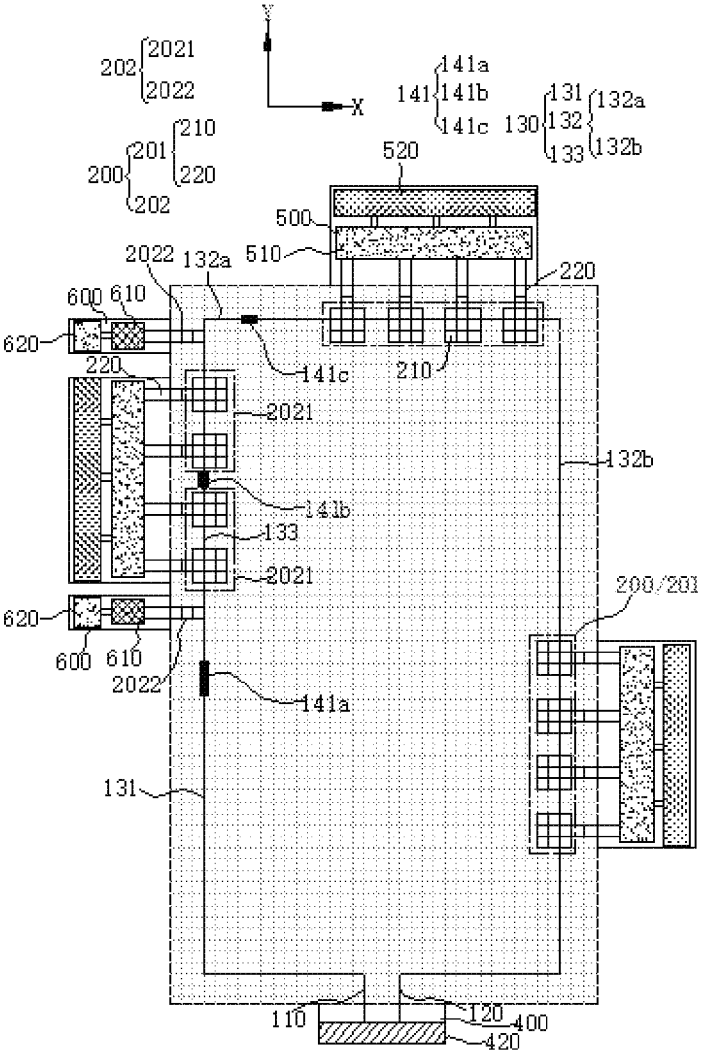
FIG. 20 is a schematic structural view of a wireless communication structure of a display panel according to an eighteenth embodiment of a first aspect of the present application.

For example, as shown in FIG. 20, two or more millimeter-wave antenna units 210 in the millimeter-wave antenna array 201 are reused as the non-millimeter-wave antenna 202 in FIG. 20, and the first blocking portion 141 may be arranged between the two or more millimeter-wave antenna units 210 in the millimeter-wave antenna array 201 and other millimeter-wave antenna units 210.

Optionally, in FIG. 20, for example, the first blocking portion 141 includes a first sub-blocking portion 141*a*, a second sub-blocking portion 141*b*, and a third sub-blocking portion 141*c*. Currents flowing out of the non-millimeter-wave feeding portion 2022 may flow to the first sub-blocking portion 141*a*, or currents flowing out of the non-millimeter-wave feeding portion 2022 may flow to the second sub-blocking portion 141*b*.

Optionally, the non-millimeter-wave antenna 202 in FIG. 20 is a non-millimeter-wave antenna 202 corresponding to multiple frequencies, that is, the currents flowing out of the non-millimeter-wave feeding portion 2022 to the first sub-blocking portion 141*a* and the second sub-blocking portion 141*b* are currents with frequencies within the frequencies corresponding to the non-millimeter-wave antenna 202.

Alternatively, the non-millimeter-wave antenna 202 in FIG. 20 is a non-millimeter-wave antenna 202 covering a single targeted frequency band. For example, when the currents flowing out of the non-millimeter-wave feeding portion 2022 flow to the second sub-blocking portion 141*b*, the currents are currents with frequencies within the targeted frequencies corresponding to the non-millimeter-wave antenna 202. Appropriately designing a wire path between the non-millimeter-wave feeding portion 2022 and the first sub-blocking portion 141*a* may have beneficial effects on the performance of the targeted frequencies corresponding to the non-millimeter-wave antenna 202.

Optionally, two or more millimeter-wave antenna units 210 in the millimeter-wave antenna array 201 may be reused as two non-millimeter-wave radiating portions 2021, and the first blocking portion 141 can be arranged between the two or more millimeter-wave antenna units 210 of the different millimeter-wave antenna arrays 201. For example, the millimeter-wave antenna array 201 in FIG. 20 includes four millimeter-wave antenna units 210. Two adjacent millimeter-wave antenna units 210 are reused as the non-millimeter-wave radiating portion 2021, then the first blocking portion 141 may be arranged in the middle of the four millimeter-wave antenna units 210. That is, two or more millimeter-wave antenna units 210 in a same millimeter-wave antenna array 201 are divided into two groups, and each group includes two millimeter-wave antenna units 210.

Figure 21:
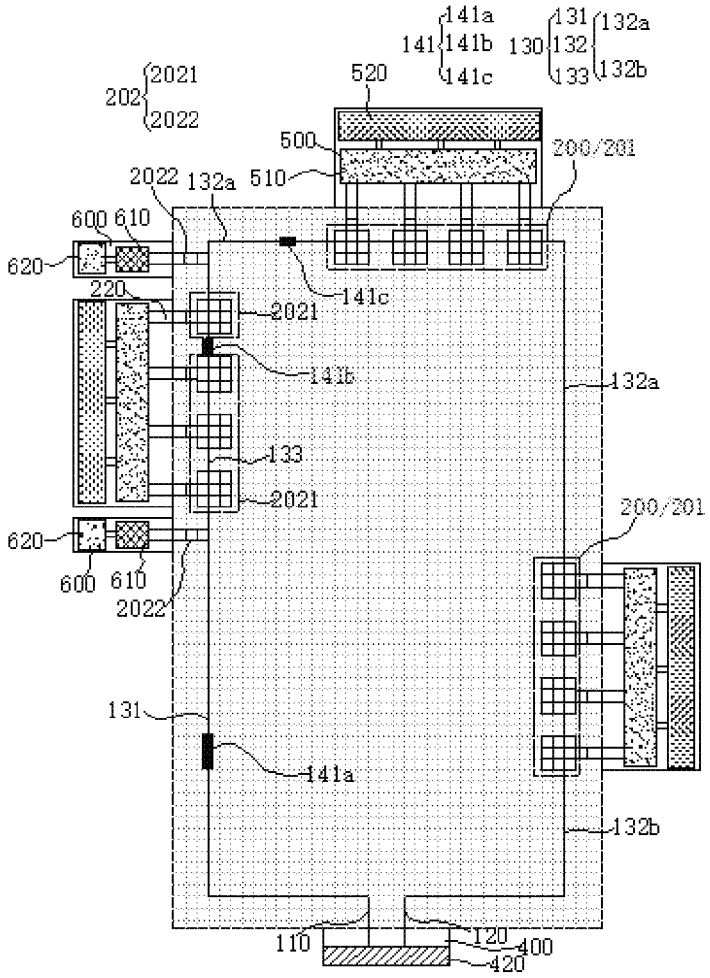
FIG. 21 is a schematic structural view of a display panel according to a nineteenth embodiment of a first aspect of the present application.

In other embodiments, as shown in FIG. 21, when at least one millimeter-wave antenna unit 210 is reused as the non-millimeter-wave radiating portion 2021, the first blocking portion 141 in the millimeter-wave antenna array 201 may be arranged between three millimeter-wave antenna units 210 and another millimeter-wave antenna unit 210.

Figure 22:
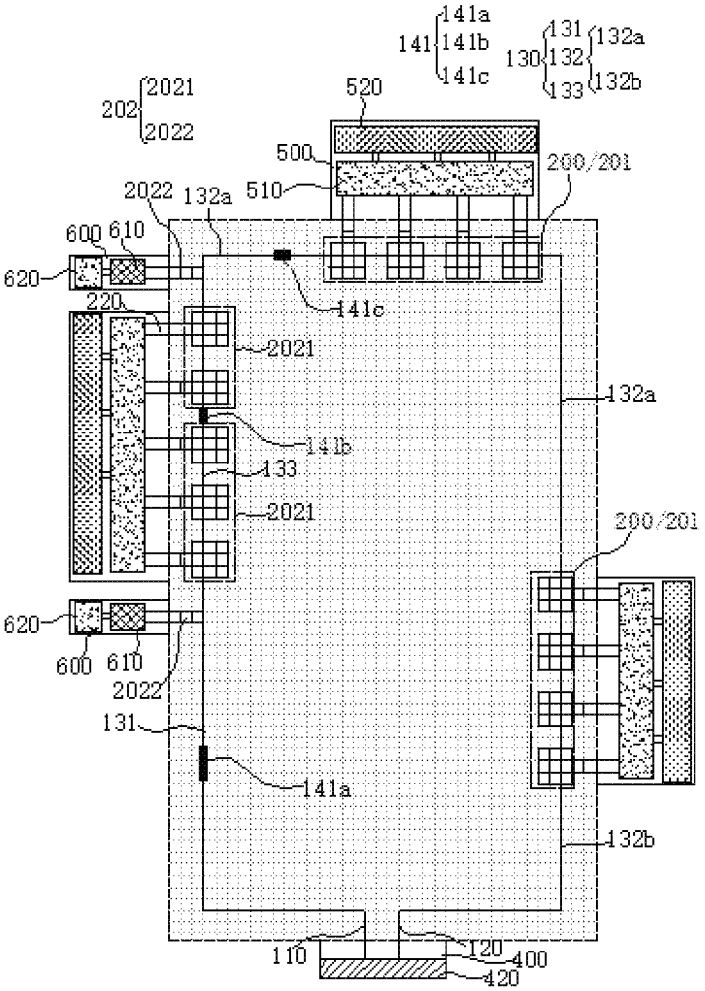
FIG. 22 is a schematic structural view of a display panel according to a twentieth embodiment of a first aspect of the present application.

In other embodiments, as shown in FIG. 22, when the number of millimeter-wave antenna units 210 is five, the first blocking portion 141 may be arranged between two millimeter-wave antenna units 210 and the other three millimeter-wave antenna units 210, or the first blocking portion 141 may be arranged between one millimeter-wave antenna unit 210 and the other four millimeter-wave antenna units 210.

Optionally, the line width of the second blocking portion 142 is not greater than the width of the millimeter-wave antenna unit 210 to block the millimeter-wave currents. The arrangement in which the line width of the second blocking portion 142 is not greater than the width of the millimeter-wave antenna unit 210 is the same as the arrangement in which the first blocking portion 142 is not greater than the width of the millimeter-wave antenna unit 210, which will not be repeated here.

Figure 23:
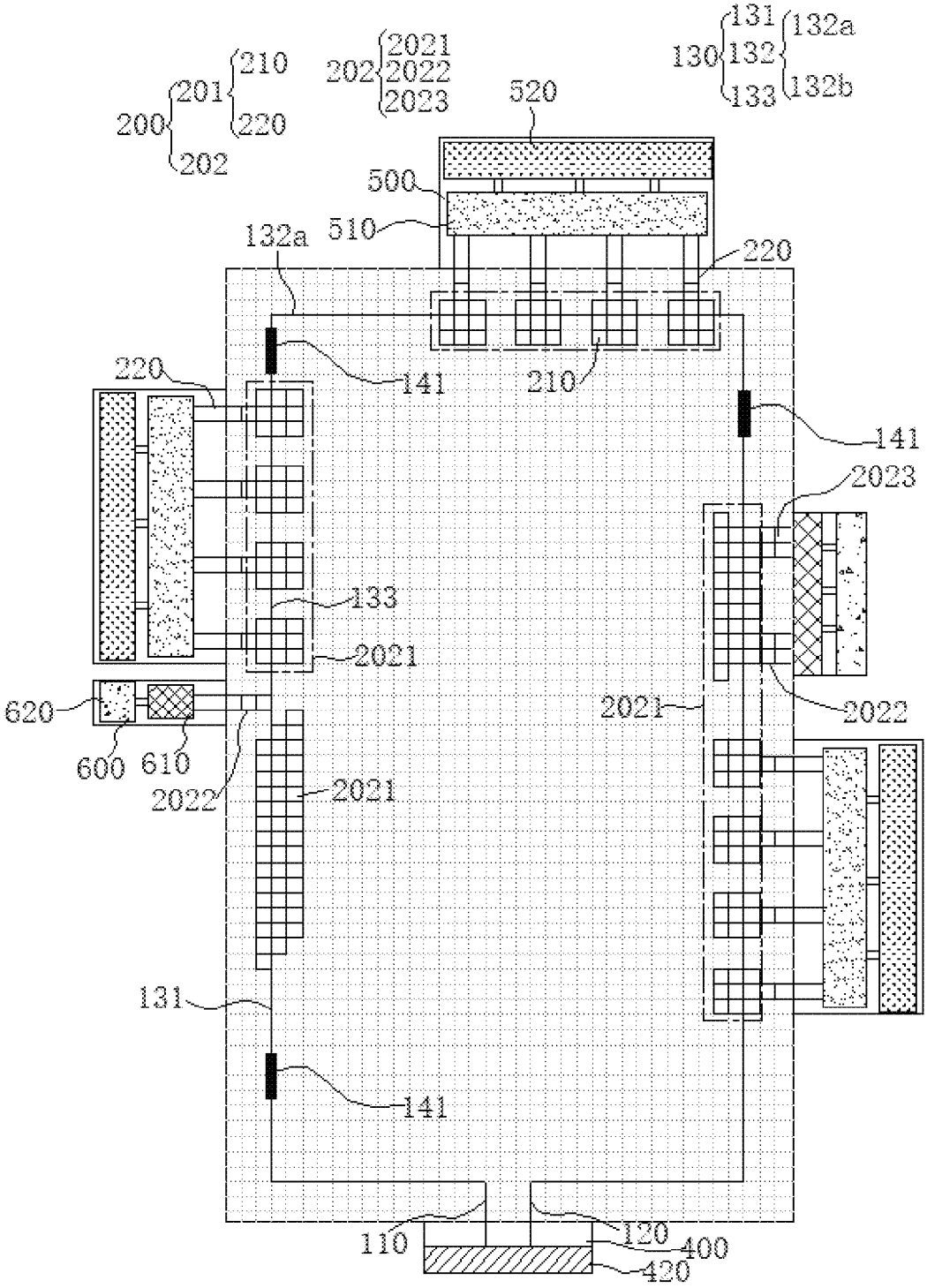
FIG. 23 is a schematic structural view of a display panel according to a twenty first embodiment of a first aspect of the present application.

Optionally, as shown in FIG. 23, when at least one millimeter-wave antenna unit 220 is reused as at least a part of the non-millimeter-wave radiating portion 2021, the currents flowing out of the non-millimeter-wave feeding portion 2022 may flow to the non-millimeter-wave radiating portion 2021 formed through reusing the millimeter-wave antenna unit 220, or the currents flowing out of the non-millimeter-wave feeding portion 2022 may flow to the non-millimeter-wave radiating portion 2021 formed through reusing the non-millimeter-wave antenna unit 220. That is, the non-millimeter-wave feeding portion 2022 may be connected to two non-millimeter-wave radiating portions 2021, and at least a part of one of the non-millimeter-wave radiating portions 2021 is formed by reusing at least one millimeter-wave antenna unit 220. Therefore, the non-millimeter-wave antenna 202 covering multiple frequency bands may be formed, that is, the non-millimeter-wave antenna 202 may transmit and/or receive wireless signals of different frequency bands with different non-millimeter-wave radiating portions 2021.

Optionally, with further reference to FIG. 23, the millimeter antenna unit 220 and other parts of the mesh lines may also together form the non-millimeter-wave radiating portion 2021. Optionally, with further reference to FIG. 23, the non-millimeter-wave antenna 202 may further include a grounded portion 2023.

Figure 24:
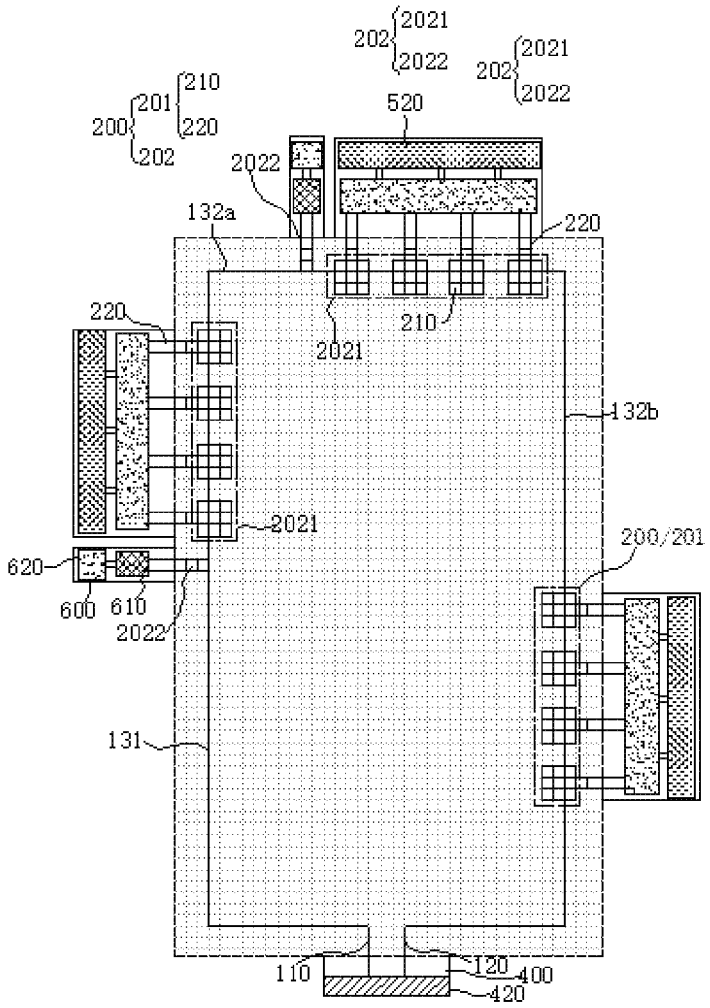
FIG. 24 is a schematic structural view of a display panel according to a twenty second embodiment of a first aspect of the present application.

Optionally, when the number of the millimeter-wave antenna arrays 201 is two or more, at least one millimeter-wave antenna unit 210 in one of the millimeter-wave antenna arrays 201 may be reused as part of the non-millimeter-wave antenna 202. Alternatively, as shown in FIG. 24, in two or more millimeter-wave antenna arrays 201, at least one millimeter-wave antenna unit 210 in each millimeter-wave antenna array 201 may be reused as part of the non-millimeter-wave antenna 202 to increase the number of the non-millimeter-wave antennas 202.

Figure 25:
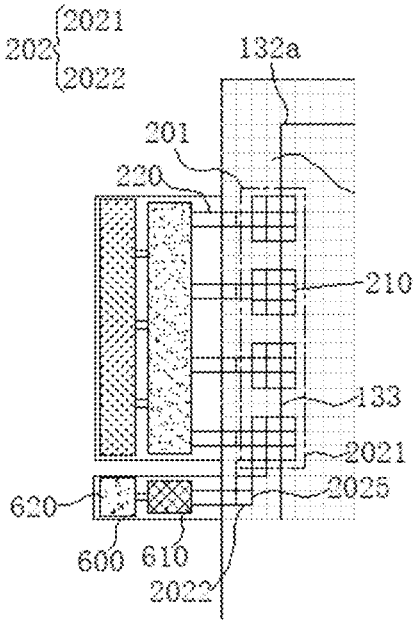
FIG. 25 is a partial magnified structural view of FIG. 13 in a twenty third embodiment.

In some other optional embodiments, as shown in FIG. 25, the non-millimeter-wave radiating portion 2021 further includes a second connection wire 202 connecting the non-millimeter-wave feeding portion 2022 to the millimeter-wave antenna unit 210. The line width of a second connection wire 2025 is different from the line width of the coil body 130, so that the coil body 130 can allow the wireless signal currents transmitted and/or received by the loop structure 100 to pass through and block the non-millimeter-wave currents transmitted and/or received by the non-millimeter-wave antenna 202.

In these optional embodiments, when at least a part of the non-millimeter-wave radiating portion 2021 and at least one millimeter-wave antenna unit 210 are reused as each other, there is no connection between the second connection wire 2025 and the coil body 130. The non-millimeter-wave wireless signals, the millimeter-wave wireless signals, and the wireless signals transmitted and/or received by the loop structure 100 can be isolated from one another by changing the line width of the coil body 130.

The line width of a second connection wire 2025 is different from the line width of the coil body 130, so that the coil body 130 can allow the wireless signal currents transmitted and/or received by the loop structure 100 to pass through and block the non-millimeter-wave currents transmitted and/or received by the non-millimeter-wave antenna 202, thereby the coil body 130 can block the non-millimeter-wave currents transmitted and/or received by the non-millimeter-wave antenna 202.

In these optional embodiments, when at least a part of the non-millimeter-wave radiating portion 2021 and at least one millimeter-wave antenna unit 210 are reused as each other, and there is no connection between the coil body 130 and the second connection wire 2025 positioned between the non-millimeter-wave radiating portion 2021 and the non-millimeter-wave feeding portion 2022, the non-millimeter-wave wireless signals and the millimeter-wave wireless signals can be blocked on the coil body 130 by appropriately setting the line width of the coil body 130.

The loop structure 100 and the antenna 200 may be arranged in various positions, as shown in FIG. 1 to FIG. 25, in some optional embodiments, the display panel further includes a touch layer 300. The touch layer 300 includes the mesh-shaped metal wiring. The loop structure 100 and the antenna 200 are both positioned in the touch layer 300. In these optional embodiments, the loop structure 100 and the antenna 200 are arranged in the touch layer 300, so that the loop structure 100 and the antenna 200 can reuse the mesh-shaped metal wiring without adding an additional structure layer, which can reduce the overall thickness of the display panel. In addition, when the at least one loop structure 100 and the antenna 200 are connected to each other, the cutting points of the mesh-shaped metal wiring can be reduced to ensure desired touch effects of the touch layer 300 and the optical effects of the display panel.

Optionally, when the antenna 200 is positioned in the touch layer 300, as shown in FIG. 12 and FIG. 13, the millimeter-wave antenna unit 210 of the millimeter-wave antenna array 201 includes multiple first wires 211 extending along the first direction X and multiple second wires 212 extending along the second direction Y. The first direction X intersects the second direction Y. For example, the first direction X and the second direction Y are perpendicular to each other, or an angle between the first direction X and the second direction Y is 30 degrees, 45 degrees, 60 degrees, etc., as long as the first direction X intersects the second direction Y.

In these optional embodiments, the millimeter-wave antenna unit 210 includes the first wires 211 and the second wires 212 intersecting the first wires 211, that is, the millimeter-wave antenna unit 210 is mesh-shaped, which can increase the distribution area of the millimeter-wave wires in the millimeter-wave antenna unit 210. This can reduce the impedance of the millimeter-wave antenna unit 210 and reduce energy loss of the millimeter-wave antenna unit 210 and energy reflection caused by impedance mismatch, so that the millimeter-wave antenna unit 210 can desirably transmit and/or receive the wireless signals in the millimeter-wave band. In addition, the millimeter-wave antenna unit 210 may directly use metal wires in the mesh-shaped metal wiring as the first wires 211 and the second wires 212, which can further simplify the manufacturing of the millimeter-wave antenna unit 210.

The millimeter-wave antenna unit 210 includes the first wires 211 and the second wires 212 intersecting the first wires 211, that is, the millimeter-wave wires include the first wires 211 and the second wires 212 intersecting the first wires 211. Optionally, the touch layer 300 may be formed by intersecting multiple first touch wires parallel to the first wires 211 and multiple second touch wires parallel to the second wires 212.

Figure 26:
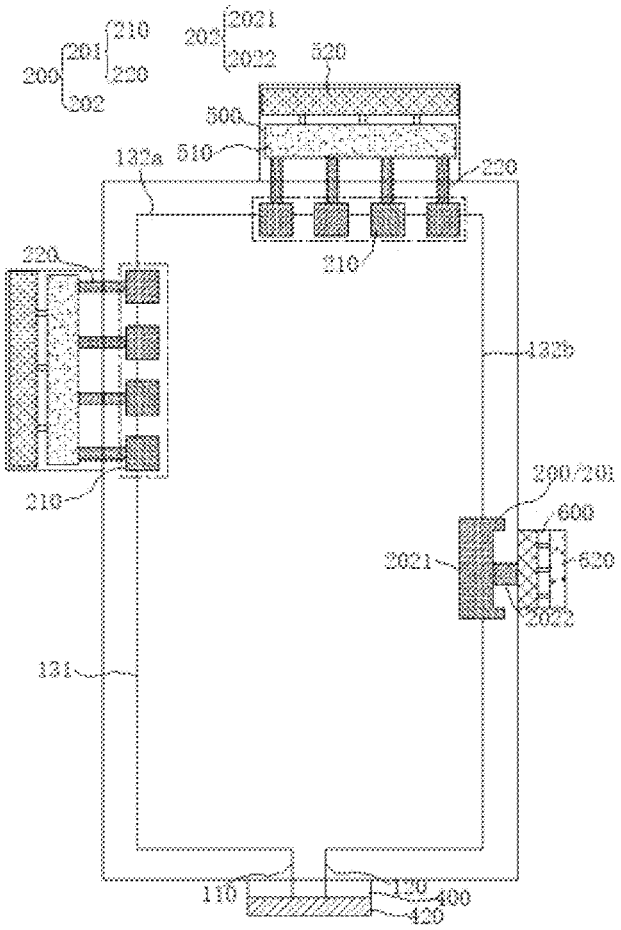
FIG. 26 is a schematic structural view of a wireless communication structure of a display panel according to a twenty fourth embodiment of a first aspect of the present application.

In some other embodiments, as shown in FIG. 26, the display panel may further include an antenna layer, and the loop structure 100 and the antenna 200 are positioned in the antenna layer. In these optional embodiments, by adding a non-mesh-shaped antenna layer in the display panel, the impedance of the antenna 200 and the impedance of the loop structure 100 can be reduced, energy loss of the antenna 200 and the loop structure 100 and the energy reflection caused by impedance mismatch can be reduced, thus the performance of the antenna 200 and the loop structure 100 can be improved. Optionally, the loop structure 100 and the antenna 200 in the antenna layer may be manufactured by etching. In other embodiments, the antenna layer may be independently arranged and attached on the display panel. The loop structure 100 and the antenna 200 in the antenna layer may be manufactured by other implementations.

When the loop structure 100 and the antenna 200 are arranged in the antenna layer, the millimeter-wave antenna unit 210 can be in the shape of block, so as to increase the distribution area of conductive materials in the millimeter-wave antenna unit 210 and reduce the impedance of the millimeter-wave antenna unit 210. This can reduce energy loss of the millimeter-wave antenna unit 210 and the energy reflection caused by impedance mismatch, so that the millimeter-wave antenna unit 210 can have a better performance of transmitting and/or receiving the millimeter-wave wireless signals.

When the millimeter-wave antenna unit 210 is in the shape of block, the millimeter-wave antenna unit 210 may be in a shape of a square, a diamond, a circle, or the like.

Optionally, when the loop structure 100 and the antenna 200 are arranged by adding the antenna layer in the display panel, and the display panel itself includes the touch layer 300, the antenna layer may be arranged on a side of the touch layer 300 facing the cover plate of the display panel, or the antenna layer is arranged on a side of the touch layer 300 facing away from the cover plate of the display panel.

Figure 27:
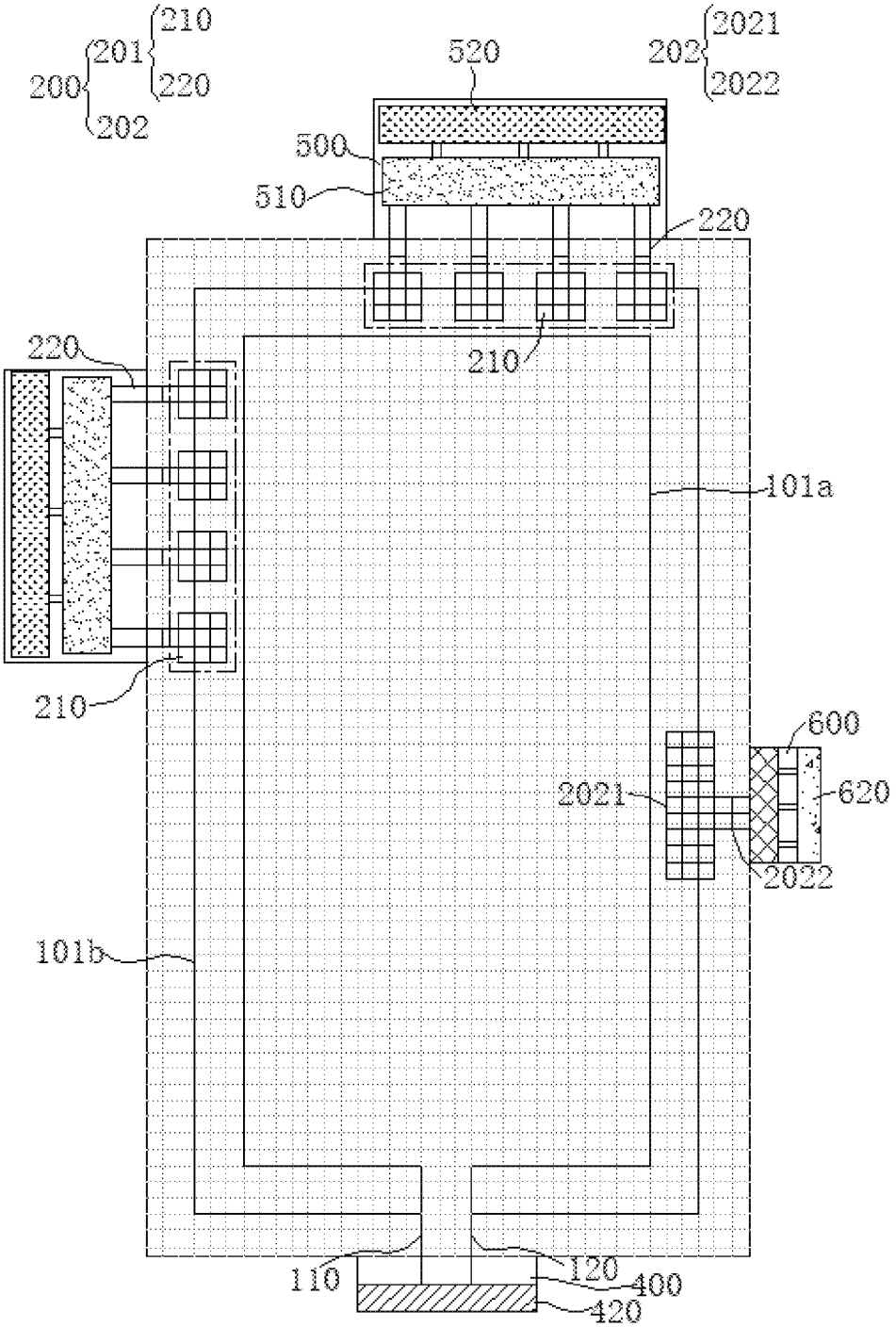
FIG. 27 is a schematic structural view of a wireless communication structure of a display panel according to a twenty fifth embodiment of a first aspect of the present application.

In some optional embodiments, as shown in FIG. 27, when the coil body 130 includes multiple coils, the multiple coils may be connected in series, in parallel or coupled with one another. Multiple coil bodies 130 may be arranged as intersecting one another or being spaced apart from one another.

Optionally, the multiple coils include an inner coil 101*a* and an outer coil 101*b* surrounding a side of the inner coil 101*a* away from the center of the wireless communication structure. That is, the outer coil 101*b* is arranged closer to the edges of the wireless communication structure. When the coil 101 includes the inner coil 101*a* and the outer coil 101*b*, the antenna 200 may be connected to the inner coil 101*a* and/or the outer coil 101*b*. For example, as shown in FIG. 27, the antenna 200 is connected to the outer coil 101*b*, when the wireless communication structure is arranged in the display panel, the antenna 200 is arranged closer to the edges of the display panel, which can reduce the influence of the antenna 200 on the display effect of the display panel. In addition, when the antenna 200 is arranged in the touch layer 300, since the edges of the display panel are less frequently touched by the user for control, the antenna 200 is arranged close to the edges of the display panel, which can reduce the influence of the antenna 200 on the touch effect of the display panel.

When the number of antennas 200 is two, some of the antennas 200 may be connected to the inner coil 101*a*, and the other antennas 200 may be connected to the outer coil 101*b*. Alternatively, part of an antenna 200 is connected to the inner coil 101*a*, and the other part of the same antenna 200 is connected to the outer coil 101*b*.

Figure 28:
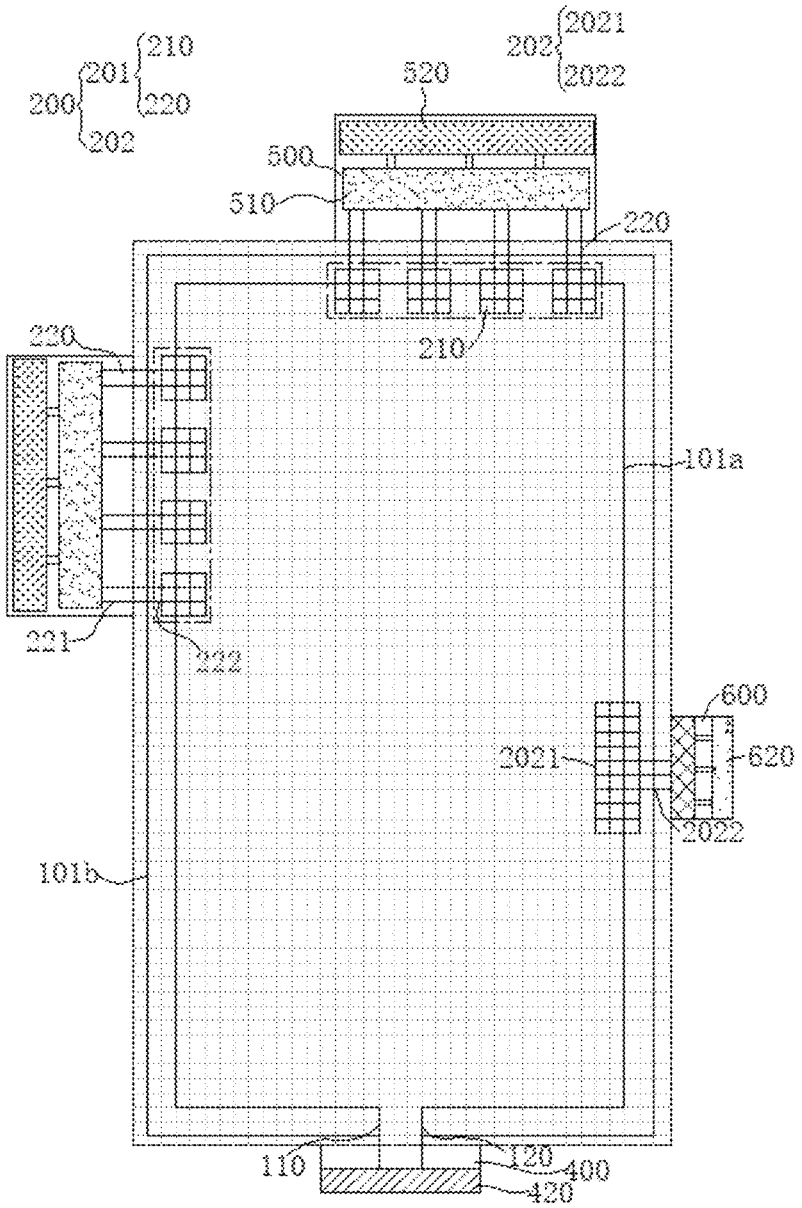
FIG. 28 is a schematic structural view of a wireless communication structure of a display panel according to a twenty sixth embodiment of a first aspect of the present application.
Figure 29:
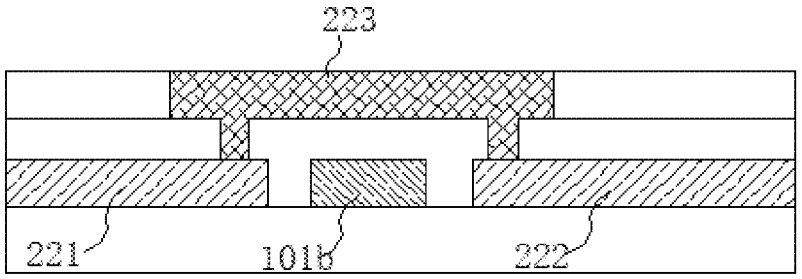
FIG. 29 is a schematic structural view of a wireless communication structure of a display panel according to a twenty seventh embodiment of a first aspect of the present application.

In some other embodiments, as shown in FIGS. 28 and 29, the antenna 200 further includes millimeter-wave antennas 210 and millimeter-wave feeding portions 220 connected to the respective millimeter-wave antenna units 210. The millimeter-wave antenna units 210 are connected to the inner coil 101*a*. The millimeter-wave antenna units 210, the inner coil 101*a* and the outer coil 101*b* may be arranged on a same layer, and the outer coil 101*b* and at least a part of the millimeter-wave feeding portion 220 may be arranged on different layers. When the millimeter-wave antenna units 210 are connected to the inner coil 101*a*, there are intersections between the millimeter-wave feeding portions 220 and the outer coil 101*b*, so that the outer coil 101*b* and at least a part of the millimeter-wave feeding portions 220 being arranged on the different layers can ensure that the millimeter-wave feeding portions 220 and the outer coil 101*b* are insulated from each other.

Optionally, the millimeter-wave feeding portion 220 includes a first conductive portion 221, a second conductive portion 222, and a bridge segment 223 connected between the first conductive portion 221 and the second conductive portion 222. The first conductive portion 221, the second conductive portion 222 and the outer coil 101*b* may be arranged on a same layer. The bridge segment 223 and the outer coil 101*b* may be arranged on the different layers, so as to ensure that the millimeter-wave feeding portion 220 and the outer coil 101*b* are insulated from each other.

In some other embodiments, the outer coil 101*b* and the entire millimeter-wave feeding portions 220 may be arranged on the different layers. Optionally, when the loop structure 100 and the antenna 200 are arranged in the touch layer 300, the touch layer 300 includes first touch electrodes and second touch electrodes arranged on a same layer. When connection portions between adjacent first touch electrodes are arranged on the same layer, adjacent second touch electrodes need to be connected to one another by bridges. The bridges and the second touch electrodes are arranged on the different layers. Optionally, the bridge segment 223 and the bridge of the touch layer 300 may be arranged on a same layer to further reduce the number of layers of the display panel, thus making the display panel lighter and thinner.

Figure 30:
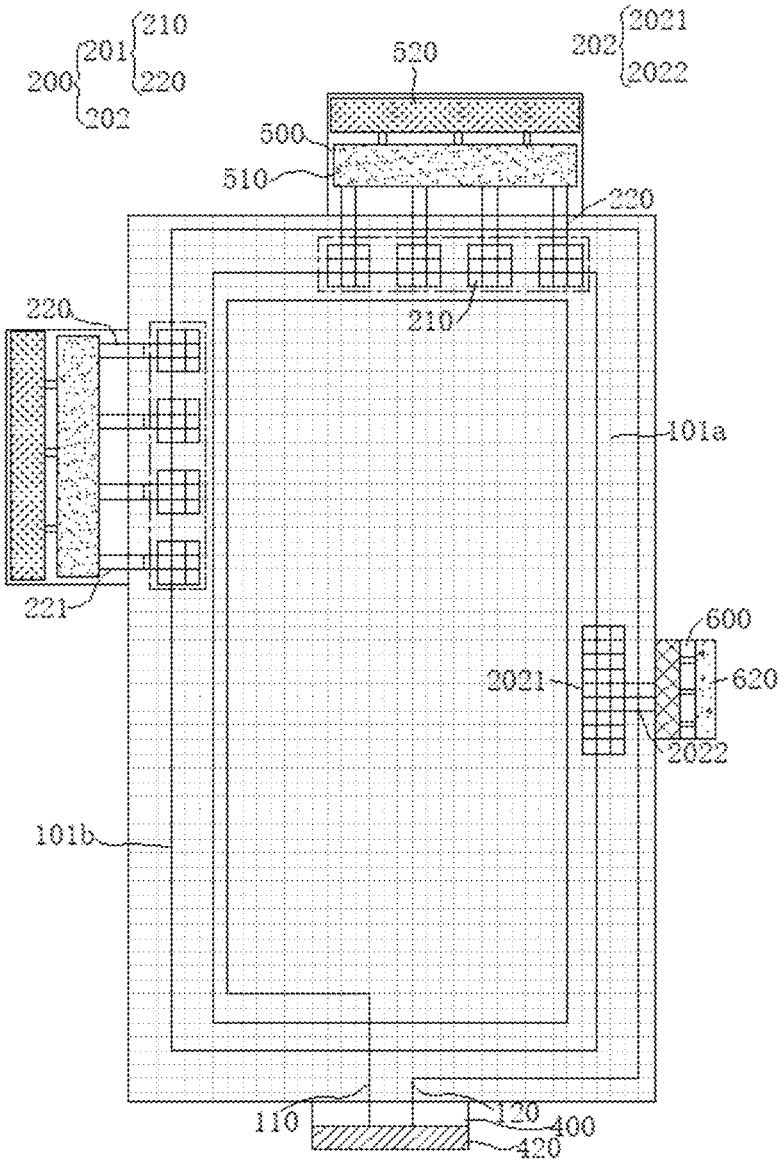
FIG. 30 is a partial cross-sectional view of FIG. 29.

Optionally, with further reference to FIG. 27 and FIG. 28, the inner coil 101*a* and the outer coil 101*b* are spaced apart from each other and connected in parallel with each other. The inner coil 101*a* and the outer coil 101*b* are arranged independently of each other. Both the inner coil 101*a* and the outer coil 101*b* are connected between the first connection end 110 and the second connection end 120. Alternatively, as shown in FIG. 30, the inner coil 101*a* and the outer coil 101*b* may be an inner coil part and an outer coil part of a helical coil, respectively, that is, the inner coil 101*a* and the outer coil 101*b* are connected in series with each other. When the inner coil 101*a* and the outer coil 101*b* are arranged as a helical coil, at least one of the first connection end 110 and the second connection end 120 overlaps part of the coil, and at least one of the first connection end 110 and the second connection end 120 may be arranged on a layer different from the coil body 130.

Figure 31:
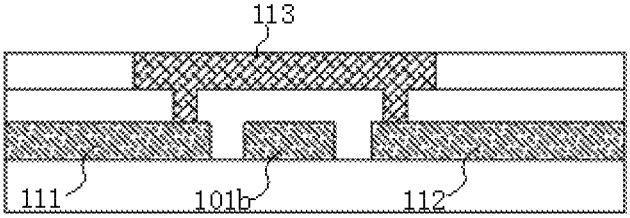
FIG. 31 is a schematic structural view of a wireless communication structure of a display panel according to a twenty eighth embodiment of a first aspect of the present application.

As shown in FIG. 30 and FIG. 31, an embodiment of the present application takes that the first connection end 110 and part of the coil body 130 overlap and are arranged on different layers as an example for illustration. When the coil body 130 is configured as multiple turns, the first connection end 110 may overlap the multi-turn coil body 130 in the extending path of the first connection end 110. As shown in FIG. 31, the first connection end 110 overlaps the coil body 130. Optionally, as shown in FIG. 31, the first connection end 110 includes a first segment 111, a second segment 112 and a spanning segment 113 connecting the first segment 111 and the second segment 112. The first segment 111 and the second segment 112 are positioned on both sides of the coil body 130, respectively. The spanning segment 113 and the coil body 130 are arranged on the different layers. An insulation layer is arranged between the spanning segment 113 and the coil body 130. Optionally, when the loop structure 100 is arranged in the touch layer 300, the spanning segment 113 and the bridges connecting the touch electrodes may be arranged on a same layer.

Figure 32:
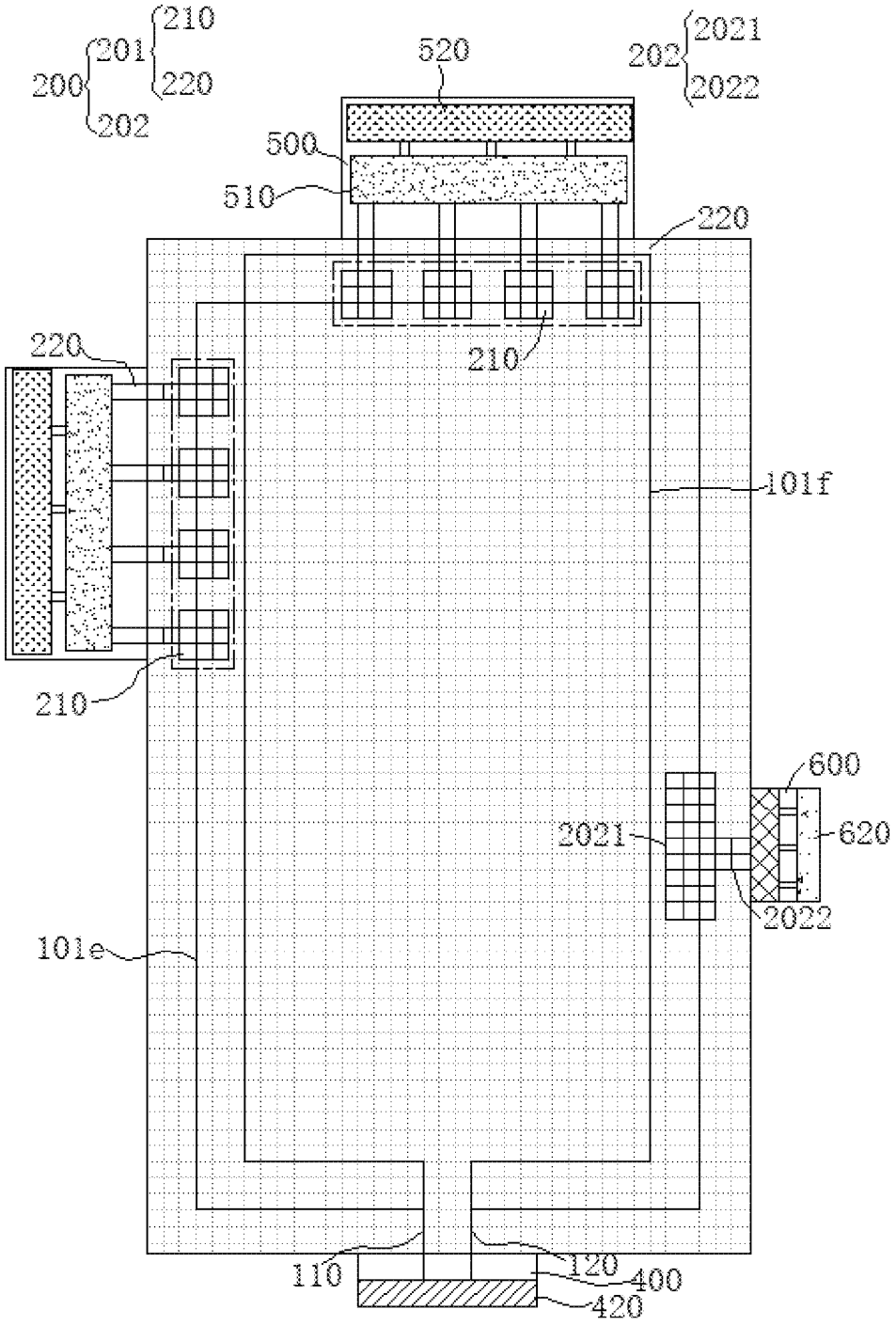
FIG. 32 is a partial cross-sectional view of FIG. 31.

Optionally, as shown in FIG. 32, the multiple coils include a first coil 101*e* and a second coil 101*f*. The first coil 101*e* and the second coil 101*f* are both connected between the first connection end 110 and the second connection end 120. Part of the first circle 101*e* is positioned on a side of the second coil 101*f* away from the center of the wireless communication structure, and part of the second coil 101*f* is positioned on a side of the first coil 101*e* away from the center of the wireless communication structure. The antenna 200 may be connected to the first coil 101*e* and/or the second coil 101*f*.

As shown in FIG. 32, a top portion of the first coil 101*e* is positioned inside a top portion of the second coil 101*f*, and a side portion of the first coil 101*e* is positioned outside a side portion of the second coil 101*f*. Lengths of the first coil 101*e* and the second coil 101*f* can be made similar or the same, so that currents in a same frequency band can flow on the first coil 101*e* and the second coil 101*f*.

Figure 33:
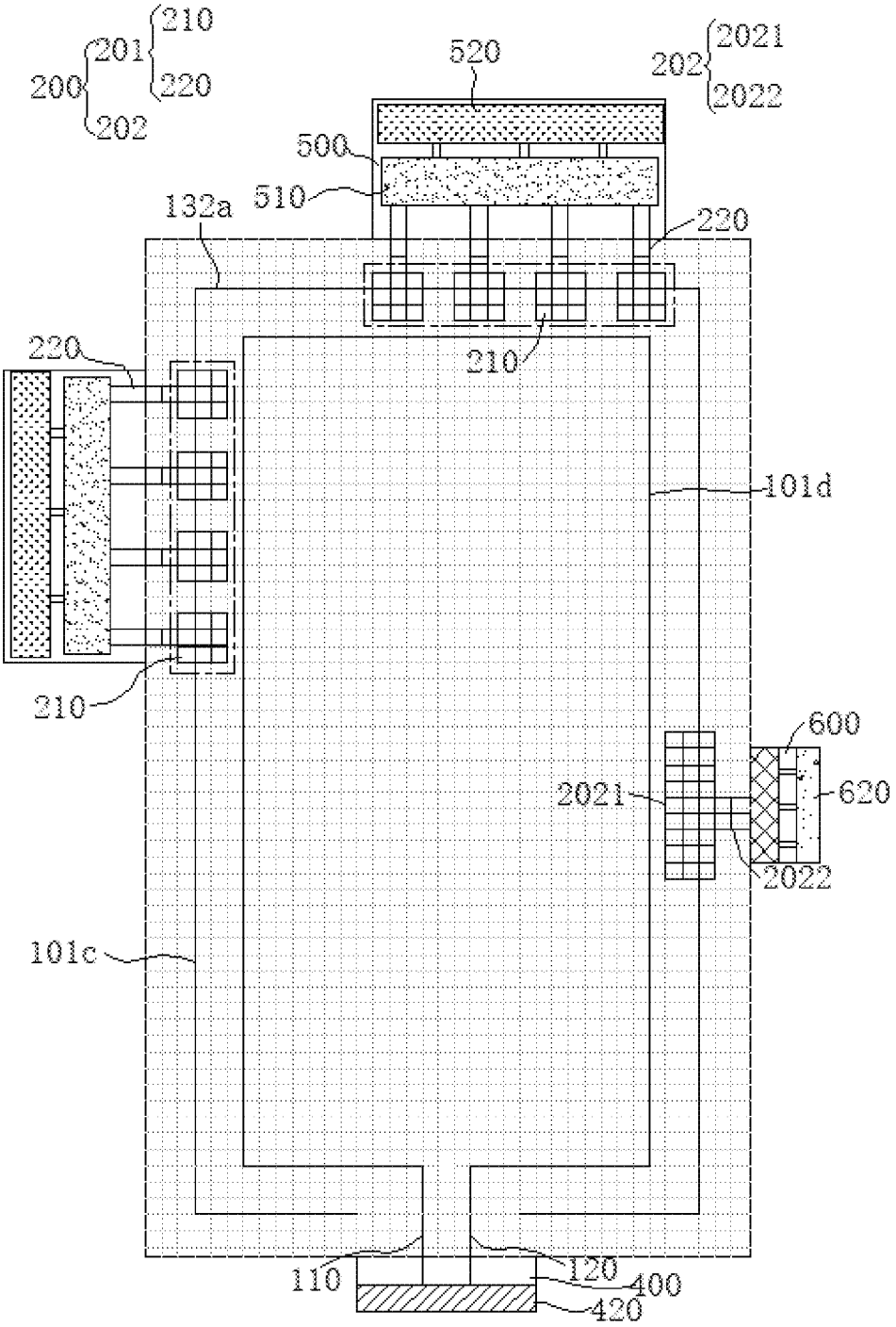
FIG. 33 is a schematic structural view of a wireless communication structure of a display panel according to a twenty ninth embodiment of a first aspect of the present application.

In some optional embodiments, as shown in FIG. 33, the coil body 130 includes multiple coils. The multiple coils include a coupled coil 101*c* and a direct-fed coil 101*d*. The direct-fed coil 101*d* is connected between the first connection end 110 and the second connection end 120. The coupled coil 101*c* is connected to the direct-fed coil 101*d* through coupling, which means that there is no direct connection between the coupled coil 101*c* and other parts of the coil body 130 and the coupled coil 101*c* is configured to generate signals by coupling with the direct-fed coil 101*d*.

When the coil body 130 includes the coupled coil 101*c* and the direct-fed coil 101*d*, the antenna 200 may be connected to the coupled coil 101*c* and/or the direct-fed coil 101*d*. For example, as shown in FIG. 33, the coupled coil 101*c* is positioned on a side of the direct-fed coil 101*d* away from the center of the wireless communication structure, and the antenna 200 is connected to the coupled coil 101*c*. In these optional embodiments, when the wireless communication structure is arranged in the display panel, the coupled coil 101*c* is positioned on a side of the direct-fed coil 101*d* close to the edges of the display panel, and the antenna 200 is connected to the coupled coil 101*c*, so that the antenna 200 is arranged closer to the edges of the display panel. For example, when the antenna 200 is arranged in the touch layer 300, the influence of the antenna 200 on the touch effect of the touch layer 300 can be reduced. In addition, the antenna 200 is arranged close to the edges of the display panel instead of close to the center of the display panel, which can also reduce the influence of the antenna 200 on the display effect of the display panel.

Figure 34:
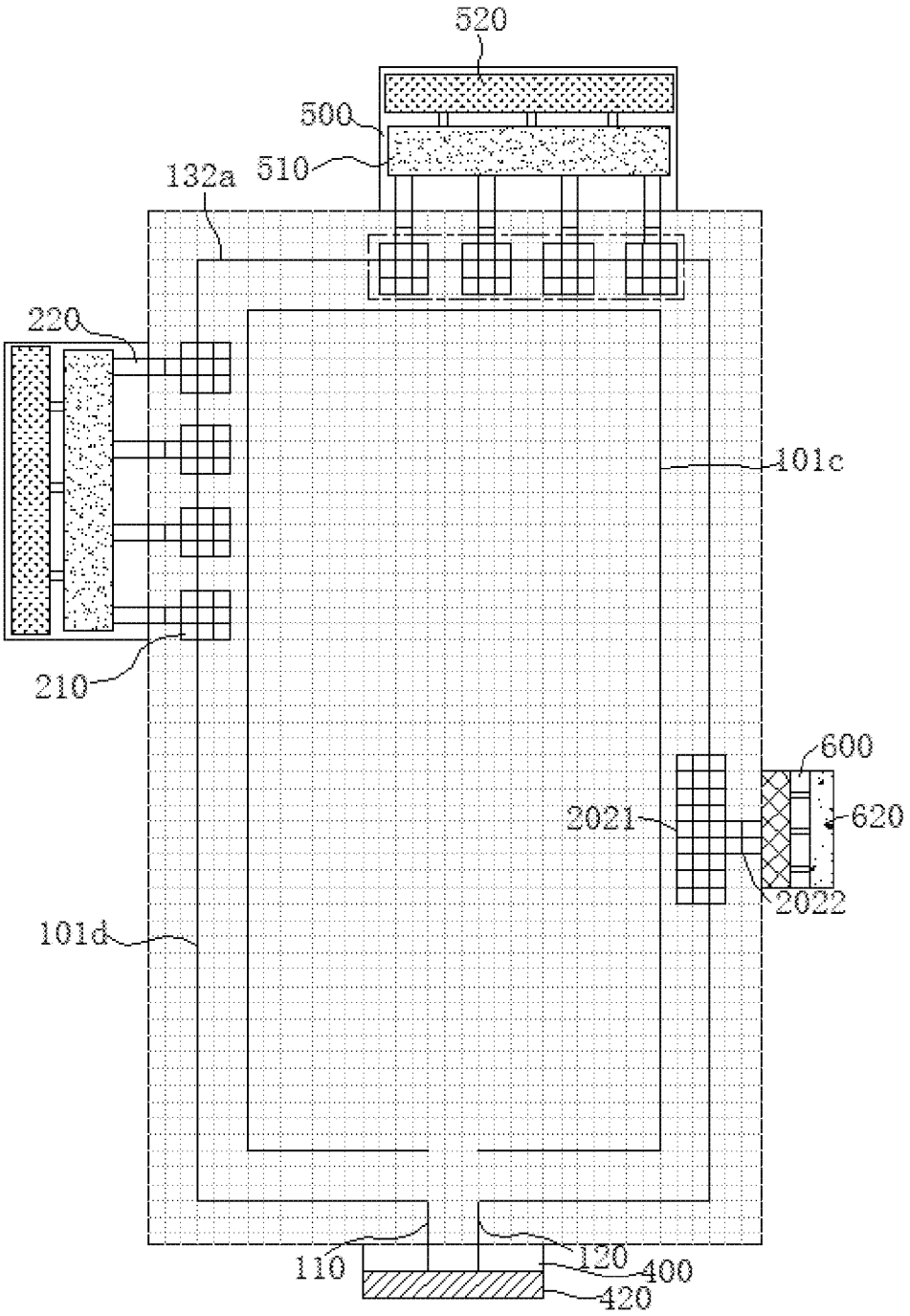
FIG. 34 is a schematic structural view of a wireless communication structure of a display panel according to a thirtieth embodiment of a first aspect of the present application.

In other optional embodiments, as shown in FIG. 34, the direct-fed coil 101*d* is positioned on a side of the coupled coil 101*c* away from the center of the wireless communication structure, and the antenna 200 is connected to the direct-fed coil 101*d*. When the wireless communication structure is arranged in the display panel, the antenna 200 is arranged closer to the edges of the display panel. In addition, in an embodiment of the present application, by providing the coupled coil 101*c*, the performance of transmitting and/or receiving the wireless signals of the loop structure 100 can be further improved. For example, when the loop structure 100 is the NFC coil, the coupled coil 101*c* can enhance the performance of transmitting and/or receiving the wireless signals of the NFC coil.

Figure 35:
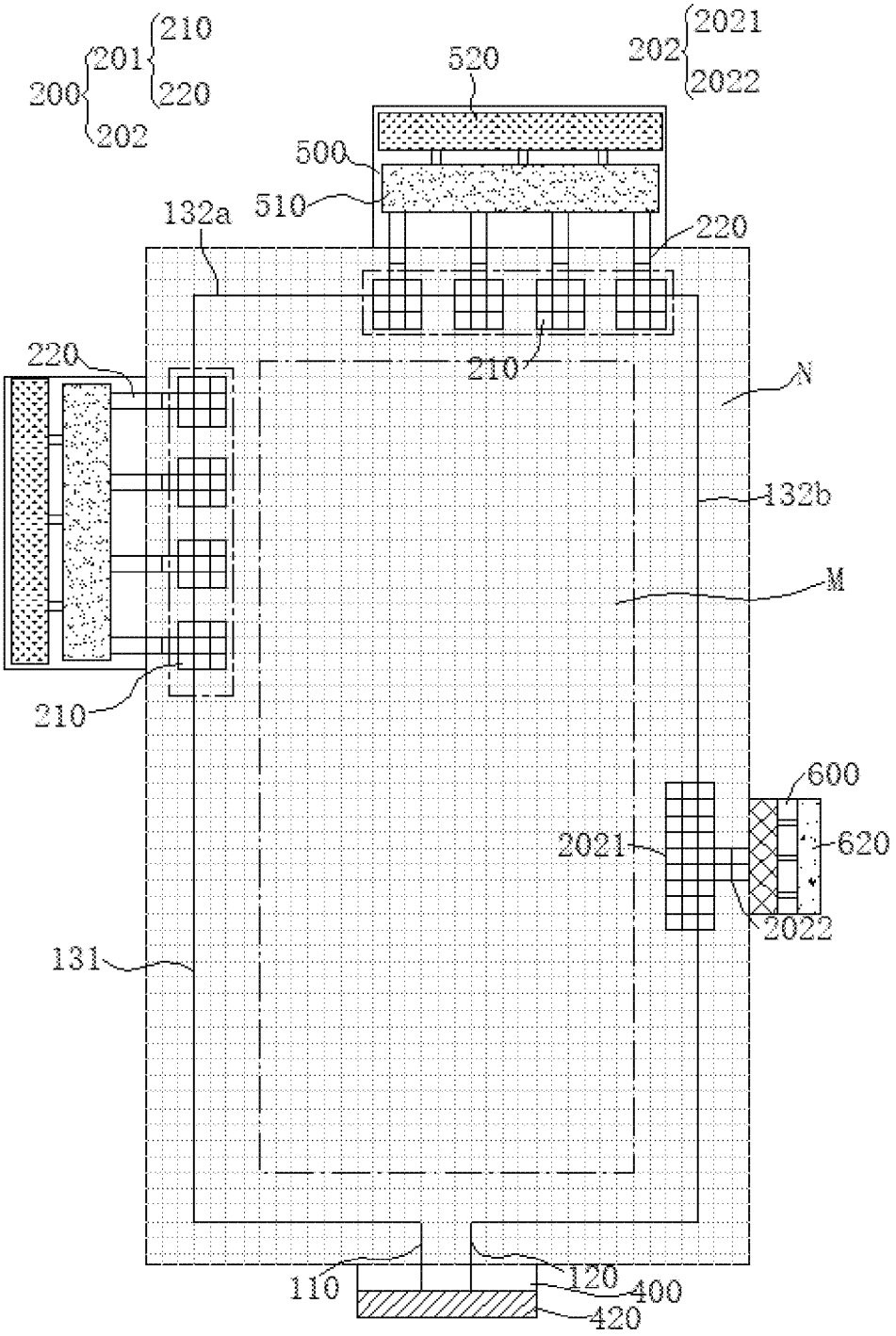
FIG. 35 is a schematic structural view of a wireless communication structure of a display panel according to a thirty first embodiment of a first aspect of the present application.

In some optional embodiments, as shown in FIG. 35, the display panel includes a first area M and a second area N surrounding the first area M. The loop structure 100 is positioned in the second area N. The second area N surrounds the first area M, so that the second area N is arranged closer to the edges of the display panel. The loop structure 100 and the antenna 200 are both positioned in the second area N, which can reduce the influence of the loop structure 100 and the antenna 200 on the display effect of the display panel. When the loop structure 100 and the antenna 200 are arranged in the touch layer 300, the influence of the loop structure 100 and the antenna 200 on the touch effect can also be reduced. Optionally, the antenna 200 may be positioned in the second area N, or the antenna 200 may be partially arranged in the first area M.

The second area N may be configured in various manners. For example, the second area N may include a display area; and/or the second area N is a non-display area. When the second area N includes a non-display area, the loop structure 100 and the antenna 200 are positioned in the non-display area, which can desirably reduce the influence of the loop structure 100 on the display effect and the touch effect. The loop structure 100 may be arranged in the first area M in various manners. For example, as shown in FIG. 35, the loop structure 100 is arranged in the second area N and around the first area M, which can increase an extension length of the loop structure 100 and increase the extension length of the coil body 130 of the loop structure 100, so as to implement a designed target frequency band and enhance the wireless performance of the frequency band.

Optionally, as shown in FIG. 35, the first connecting end 110 and the second connecting end 120 are arranged close to each other. The coil body 130 extends around the first area M from the first connecting end 110 and then is connected to the second connecting end 120. The distance between the first connecting end 110 and the second connecting end 120 is small, which not only facilitates the integration of a connector for transmitting signals from/to the first connecting end 110 and a connector for transmitting signals from/to the second connecting end 120, but also increases the extension length of the coil body 130 to implement the designed target frequency band, thereby enhancing the wireless performance of the frequency band.

Figure 36:
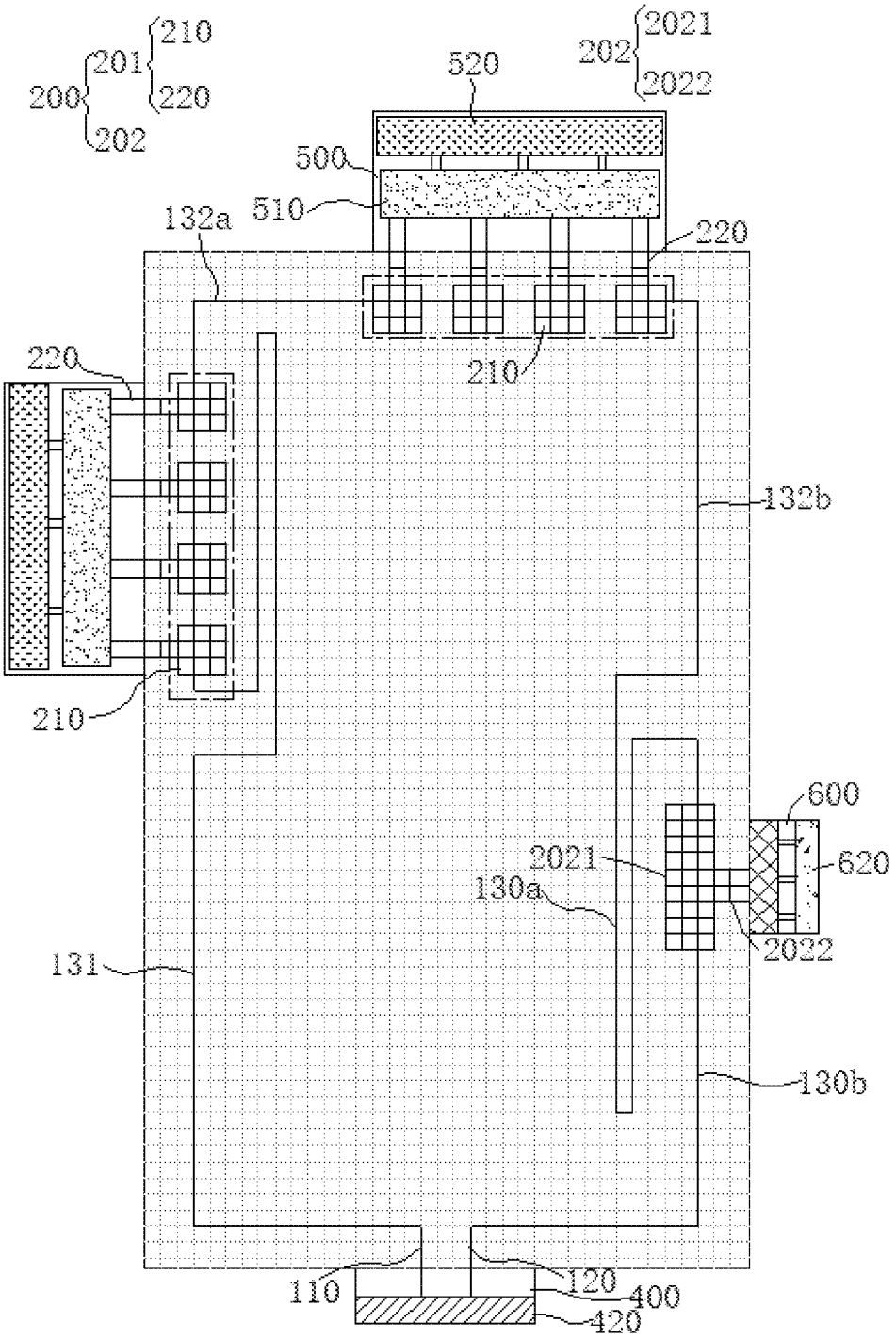
FIG. 36 is a schematic structural view of a wireless communication structure of a display panel according to a thirty second embodiment of a first aspect of the present application.

In some embodiments, as shown in FIG. 36, the coil body 130 extends along a winding path. A same coil body 130 includes a first extension segment 130*a* and a second extension segment 130*b* that overlap each other in a direction approaching the edges of the wireless communication structure. In these optional embodiments, the coil body 130 extends along the winding path, and one part overlaps another part of the coil body 130 in the direction approaching the edges of the wireless communication structure, which can increase the extension length of the coil body 130 to implement the designed target frequency band, and improve the wireless performance of the coil body 130.

Optionally, the antenna 200 is connected to the second extension segment 130*b*. When the wireless communication structure is arranged in the display panel, the second extension segment 130*b* is closer to the edges of the display panel than the first extension segment 130*a*. When the antenna 200 is connected to the second extension segment 130*b*, the antenna 200 is closer to the edges of the display panel, which can reduce the influence of the antenna 200 on the touch effect and display effect of the display panel.

Figure 37:
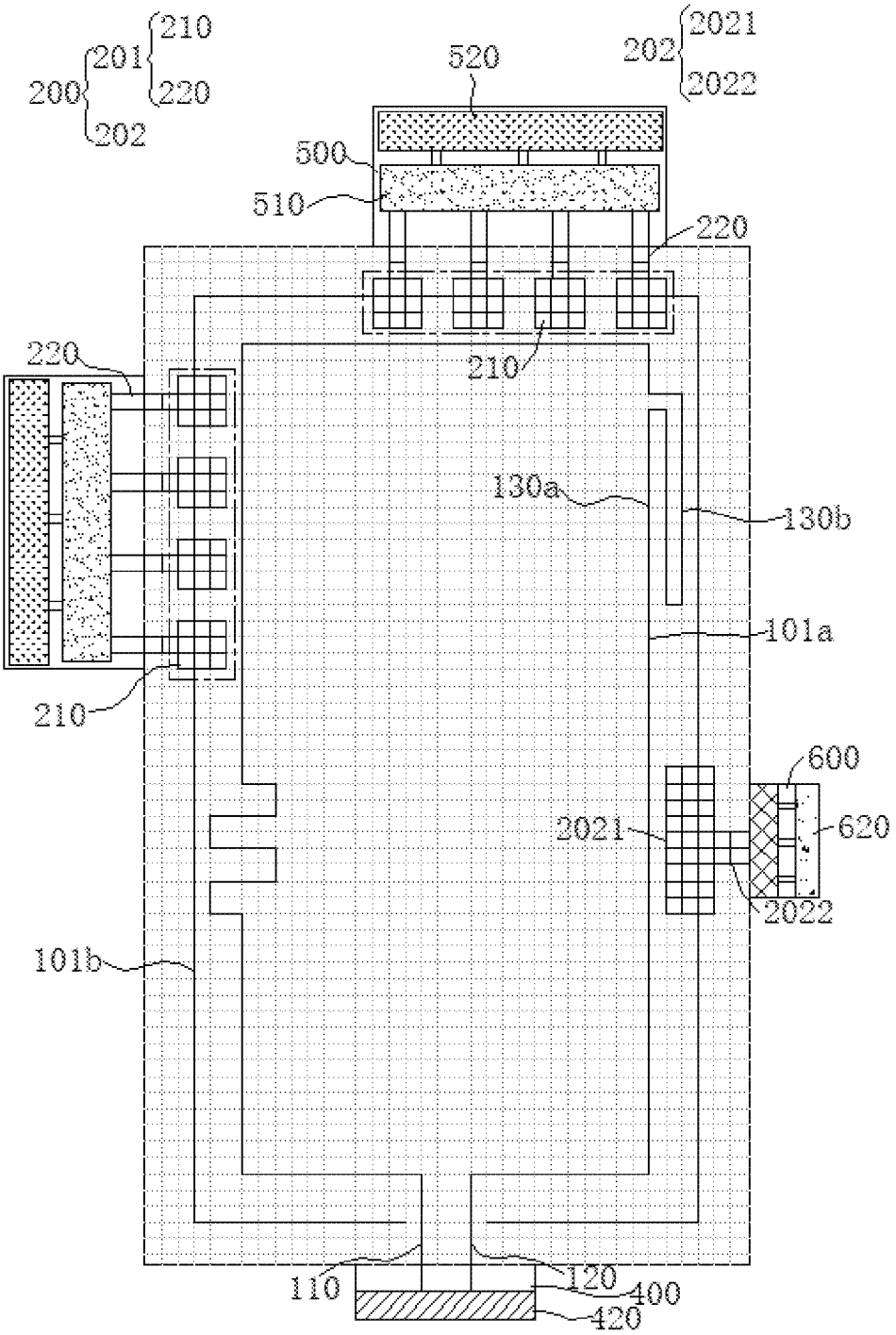
FIG. 37 is a schematic structural view of a wireless communication structure of a display panel according to a thirty third embodiment of a first aspect of the present application.

Optionally, as shown in FIG. 37, when the coil body 130 includes the inner coil 101*a* and the outer coil 101*b*, the first extension segment 130*a* and the second extension segment 130*b* may be arranged on the inner coil 101*a*, which can also increase the extension length of the coil body 130, so as to implement the designed target frequency band and improve the wireless performance of the coil body 130. Optionally, as shown in FIG. 37, when the coil body 130 includes the inner coil 101*a* and the outer coil 101*b*, the first extension segment 130*a* and the second extension segment 130*b* may be arranged on the inner coil 101*a*, which can also increase the extension length of the coil body 130, so as to implement the designed target frequency band and improve the wireless performance of the coil body 130.

Figure 38:
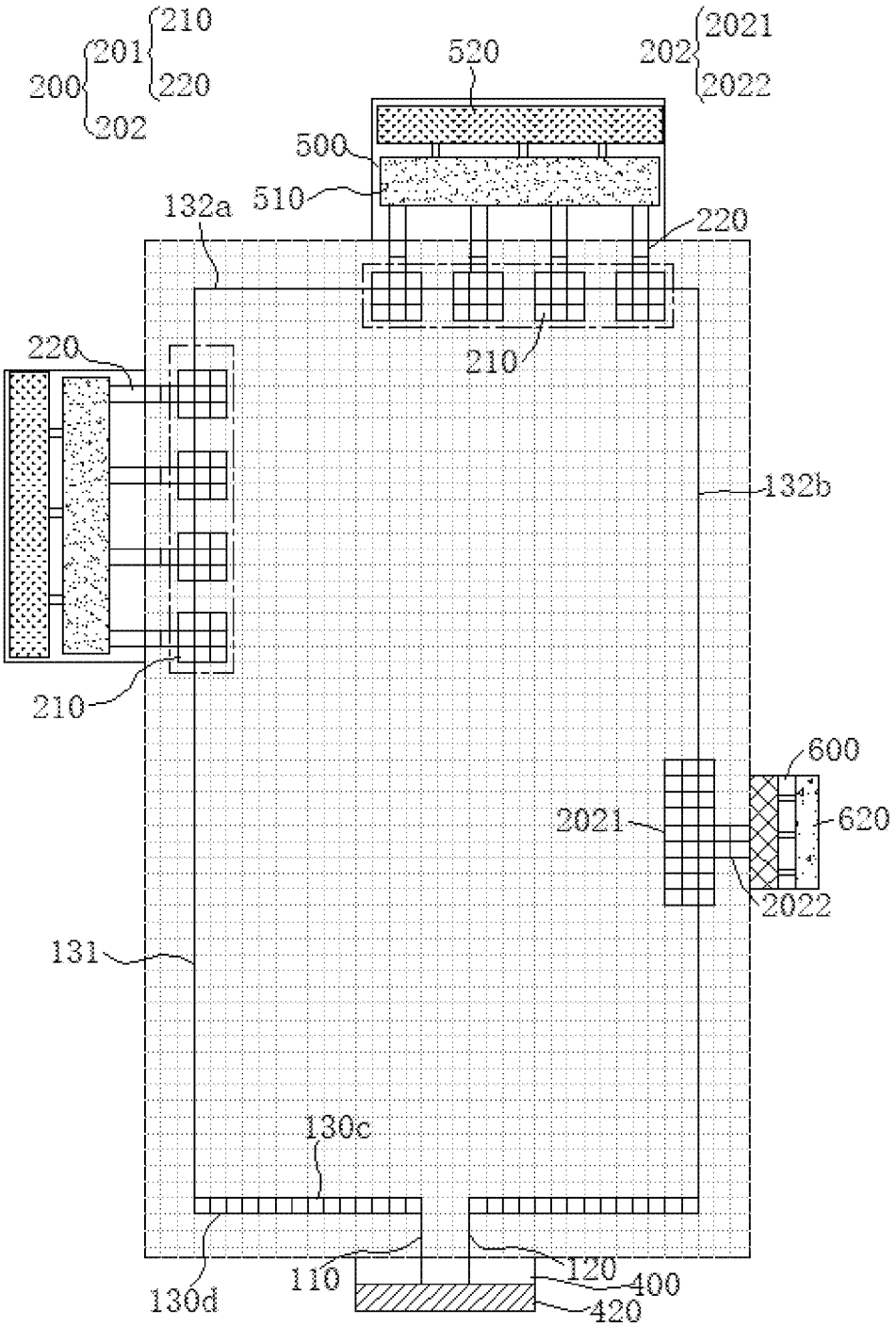
FIG. 38 is a schematic structural view of a wireless communication structure of a display panel according to a thirty fourth embodiment of a first aspect of the present application.

In some optional embodiments, as shown in FIG. 38, at least a part of the coil body 130 includes a first segment 130*c* and a second segment 130*d* connected to each other, that is, at least a part of the coil body 130 is provided with a double-stranded wire, which can reduce the impedance of the coil body 130 and thus reduce energy loss and energy reflection caused by impedance mismatch, thereby improving the wireless performance of the coil body 130.

Optionally, the antenna 200 is not aligned with the first segment 130*c* or the second segment 130*d*, that is, the antenna 200 is connected to the non-double-stranded wire portion of the coil body 130, which can simplify the connection between the antenna 200 and the coil body 130.

Figure 39:
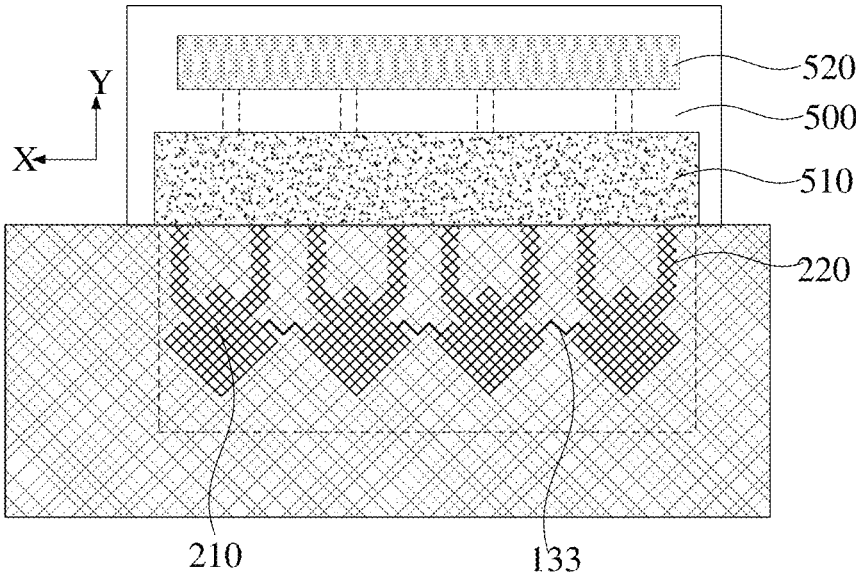
FIG. 39 is a schematic structural view of a wireless communication structure of a display panel according to a thirty fifth embodiment of a first aspect of the present application.

In any one of the embodiments above, the millimeter-wave antenna unit 210 of the millimeter-wave antenna array 201 may be a unit of single-polarization millimeter-wave antenna array 201. Alternatively, as shown in FIG. 39, the millimeter-wave antenna unit 210 of the millimeter-wave antenna array 201 is a dual-polarization millimeter-wave antenna unit 210.

In any of the above embodiments, different parts of the coil body 130 may be arranged on a same layer, that is, the first connection segment 131, the second connection segment 132 and the third connection segment 133 may be arranged on a same layer. Alternatively, different parts of the coil body 130 may be positioned on the different layers. For example, at least two of the first connection segment 131, the second connection segment 132 and the third connection segment 133 are positioned on different film layers. Different parts of at least one of the first connection segment 131, the second connection segment 132 and the third connection segment 133 may be positioned on a same layer. Alternatively, different parts of at least one of the first connection segment 131, the second connection segment 132 and the third connection segment 133 may be positioned on different layers. For example, different parts of the first connection segment 131 may be positioned on different layers, different parts of the second connection segment 132 may be positioned on different layers, and/or different parts of the third connection segment 133 may be positioned on different layers.

Figure 40:
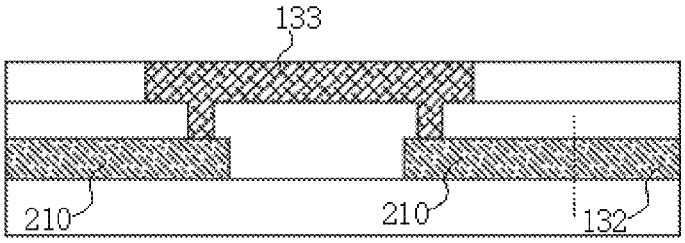
FIG. 40 is a partial cross-sectional view of FIG. 14.

Reference is made to FIG. 40, which is a partial cross-sectional view taken along line A-A in FIG. 14. Optionally, the second connection segment 132 and the antenna 200 may be arranged on a same layer, and the third connection segment 133 and the second connection segment 132 may be arranged on different layers.

As shown in FIG. 41 to FIG. 47, in a second aspect, an embodiment of the present application further provides a wireless communication device, including the display panel according to any foregoing embodiment of the first aspect. Since the wireless communication device provided by an embodiment in the second aspect of the present application includes the display panel of any of the above embodiments, the wireless communication device provided by an embodiment in the second aspect of the present application has the beneficial effects of the display panel of any of the above embodiments of the first aspect, and will not be repeated here.

The wireless communication apparatus in an embodiment of the present application include but are not limited to a device with display functions, such as a cell phone, a wireless wearable device, a personal digital assistant (PDA), a tablet computer, an e-book, a television, an access control, a smart fixed phone, a console, or the like.

Figure 41:
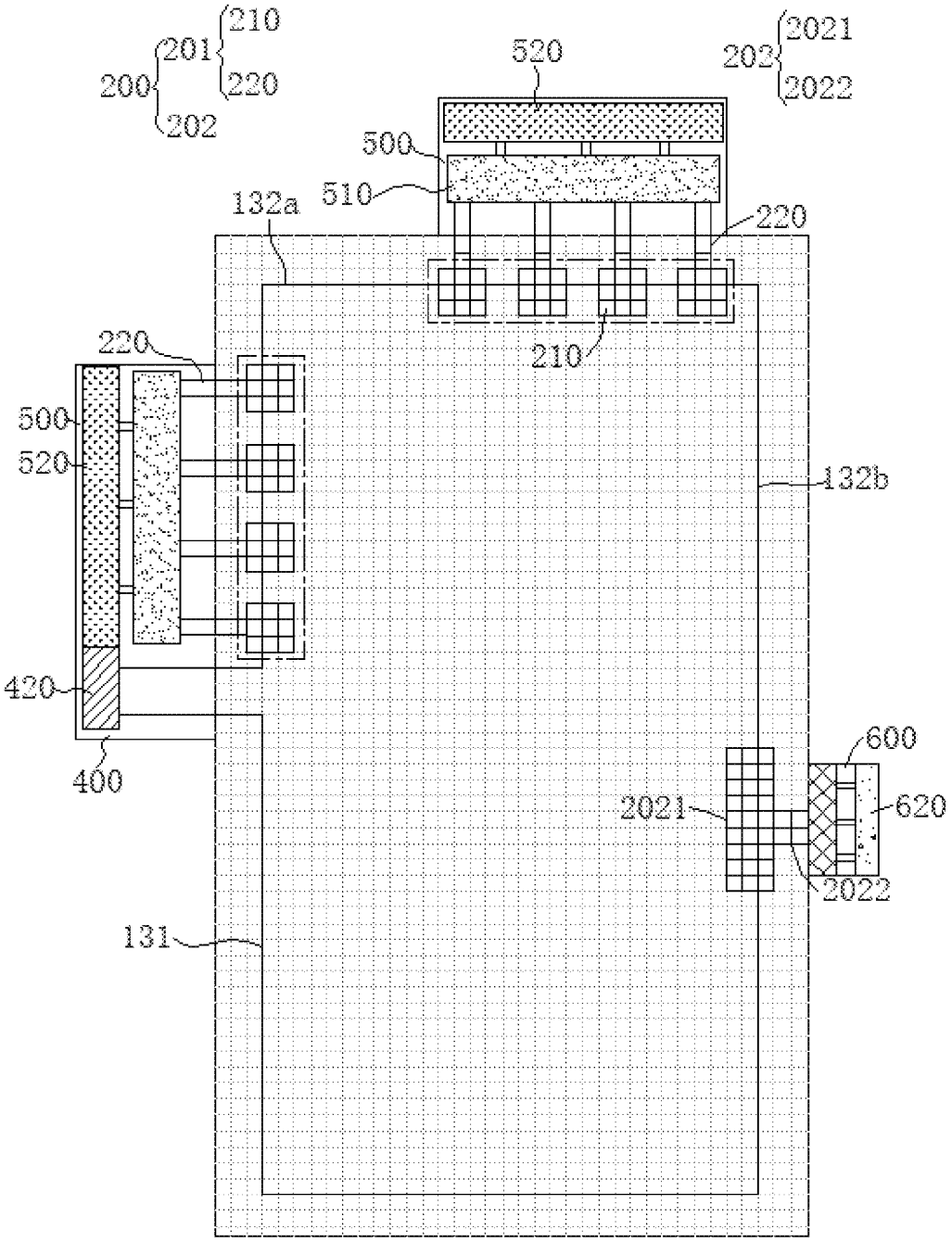
FIG. 41 is a schematic structural view of a wireless communication device according to a first embodiment of a second aspect of the present application.

In some optional embodiments, as shown in FIG. 41, the wireless communication device further includes a first circuit board 400 and a second circuit board 500. The first circuit board 400 is provided with a first transmission line in communication with the first connecting end 110 and/or the second connecting end 120 of at least one coil body 130. The second circuit board 500 is provided with a second transmission line in communication with the millimeter-wave antenna array 201.

Optionally, as shown in FIG. 41, the antenna 200 includes at least two millimeter-wave antenna units 210. Two or more millimeter-wave antenna units 210 form a millimeter-wave antenna array 201. A plurality of millimeter-wave antenna arrays 201 may be provided. Each of the plurality of millimeter-wave antenna arrays 201 is provided with a separate circuit board. The circuit boards corresponding to the plurality of millimeter-wave antenna arrays 201 may be the second circuit boards 500, so that the millimeter-wave antenna array 201 can transmit signals with the corresponding second circuit board 500 nearby.

The first circuit board 400 and the second circuit board 500 may be arranged in various manners. For example, the first circuit board 400 and the second circuit board 500 may be provided separately from each other. In some optional embodiments, as shown in FIG. 41, the first circuit board 400 and the second circuit board 500 are integrally provided, which can simplify the structure of the wireless communication device.

Optionally, the wireless communication device may further include a first integrated circuit in communication with the first connecting end 110 and/or the second connecting end 120 through the first transmission line. The first integrated circuit may be arranged in various positions. The first integrated circuit may be arranged on the first circuit board 400, or the first integrated circuit may be directly arranged on a printed circuit board (PCB) of the wireless communication device.

Optionally, the wireless communication device may further include a second integrated circuit 510 in communication with the millimeter-wave antenna array 201 through the second transmission line. The second integrated circuit 510 may be arranged in various positions. The second integrated circuit 510 may be arranged on the second circuit board 500, or the second integrated circuit 510 may be directly arranged on the PCB of the wireless communication device. In an embodiment of the present application, the first integrated circuit being arranged on the PCB of the wireless communication device and the second integrated circuit 510 being arranged on the second circuit board 500 is taken as an example for illustration.

When the loop structure 100 is an NFC coil, the first integrated circuit is an NFC radio frequency integrated circuit. When the second integrated circuit 510 is in communication with the millimeter-wave antenna array 201, the second integrated circuit 510 is a millimeter-wave radio frequency integrated circuit. Due to the filtering and frequency selecting feature of the millimeter-wave radio frequency circuit, the NFC current and the current in other non-millimeter-wave bands are significantly blocked by the millimeter-wave radio frequency circuit, and NFC current and signals in other non-millimeter-wave band do not have significant influence on the millimeter-wave radio frequency circuit, so that a desired performance of the millimeter-wave radio frequency circuit can be ensured.

Optionally, when the number of millimeter-wave antenna arrays 201 is two or more, the number of the second circuit boards 500 and the number of the second integrated circuits 510 are two or more. The second integrated circuits 510 are in communication with the millimeter-wave antenna arrays 201 through the second transmission lines on the second circuit boards 500. Two or more second circuit boards 500 may be provided separately from each other, and a first circuit board 400 may be provided integrally with any of second circuit boards 500. Alternatively, two or more second circuit boards 500 may be integrally provided, that is, a first circuit board 400 may be provided integrally with two or more second circuit boards 500, which can further simplify the structure of the wireless communication device.

In some optional embodiments, the wireless communication device further includes a first connection socket 420 and a second connection socket 520. The first connection socket 420 is provided on the first circuit board 400 and is in communication with the first transmission line on the first circuit board 400, and is configured to enable the communication between the first integrated circuit and the coil body 130 through the first connection socket 420. The second connection socket 520 is provided on the second circuit board 500 and is in communication with the second integrated circuit 510 on the second circuit board 500, and is configured to enable the signal transmission between the second integrated circuit 510 and the PCB of the wireless communication device.

That is, when the first integrated circuit is provided on the PCB of the wireless communication device, and the second integrated circuit 510 is provided on the second circuit board 500, the first connection socket 420 is configured to enable the communication between the coil body 130 and the first integrated circuit, and the second connection socket 520 is configured to enable the communication between the second integrated circuit 510 and the PCB of the wireless communication device.

The first connection socket 420 and the second connection socket 520 may be arranged in various manners. For example, when the first circuit board 400 and the second circuit board 500 are provided separately from each other, the first connection socket 420 and the second connection socket 520 are provided separately from each other.

In some optional embodiments, as shown in FIG. 41, when the first circuit board 400 and the second circuit board 500 are integrally provided, the first connection socket 420 and the second connection socket 520 are integrally provided, which can further simplify the structure of the wireless communication device.

Figure 42:
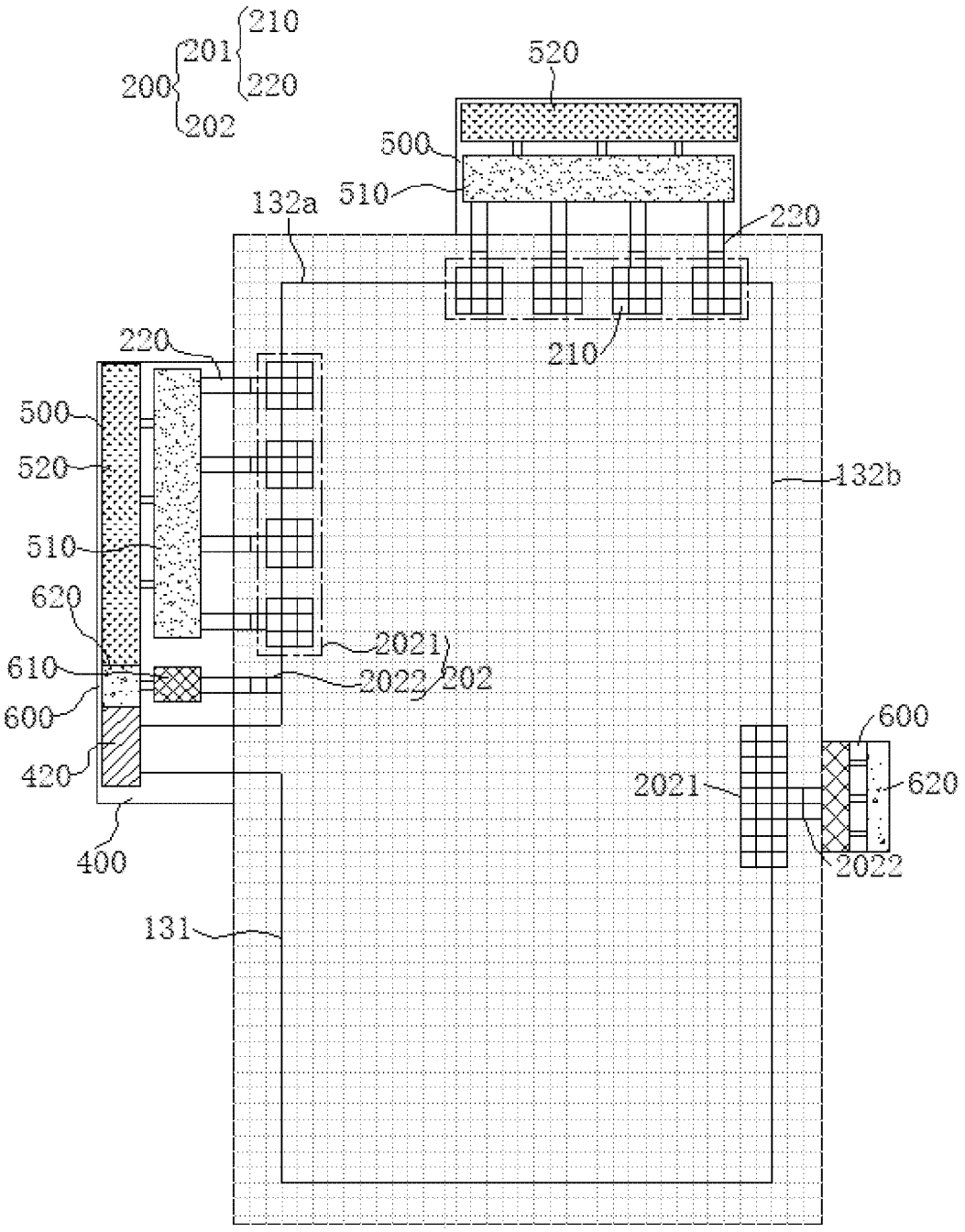
FIG. 42 is a schematic structural view of a wireless communication device according to a second embodiment of a second aspect of the present application.

In some optional embodiments, as shown in FIG. 42, the antenna 200 further includes the non-millimeter-wave antenna 202. At least one millimeter-wave antenna unit 210 is reused as part of the non-millimeter-wave antenna 202. The wireless communication device may further include a third circuit board 600. The third circuit board 600 is provided with a third transmission line. The third transmission line is in communication with the millimeter-wave antenna unit 210 reused as the non-millimeter-wave antenna 202.

At least two of the third circuit board 600, the second circuit board 500 and the first circuit board 400 are integrally provided to simplify the structure of the wireless communication device. When there are two or more millimeter-wave antenna arrays 201, there are two or more second circuit boards 500, and at least one of the third circuit board 600 and the first circuit board 400 may be integrally provided with at least one second circuit board 500.

Optionally, the wireless communication device further includes a third connection socket 620 provided on the third circuit board 600 and in communication with the third transmission line. Optionally, the third circuit board 600 further includes a third integrated circuit 610. The third connection socket 620 is in communication with the third integrated circuit 610 and is configured to enable the communication between the third integrated circuit 610 and the PCB of the display apparatus.

The third integrated circuit 610 is in communication with the non-millimeter-wave antenna 202, so that the third integrated circuit 610 is a non-millimeter-wave radio frequency integrated circuit. Because both the non-millimeter-wave radio frequency integrated circuit and the NFC radio frequency integrated circuit have the filtering and frequency selecting feature, signals in other non-millimeter-wave bands do not have a significant influence on the NFC radio frequency integrated circuit, or NFC signals do not have a significant influence on the radio frequency integrated circuits corresponding to other non-millimeter-wave bands, so as to ensure a desired performance of the NFC radio frequency integrated circuit or radio frequency integrated circuits corresponding to other non-millimeter-wave bands.

Similarly, the third integrated circuit 610 is a non-millimeter-wave radio frequency integrated circuit, the second integrated circuit 510 is a millimeter-wave radio frequency integrated circuit, and the first integrated circuit is a NFC radio frequency integrated circuit. Due to the filtering and frequency selecting feature of the NFC radio frequency circuit, signals in the millimeter-wave band and the non-millimeter-wave band do not have a significant influence on the performance of the NFC radio frequency integrated circuit.

When the wireless communication device includes three different types of connection sockets including the first connection socket 420, the second connection socket 520 and the third connection socket 620, at least two of the first connection socket 420, the second connection socket 520 and the third connection socket 620 are integrally provided to simplify the structure of the wireless communication device. When there are two or more antennas 200, there are two or more second connection sockets 520, and the third connection socket 620 and the first connection socket 420 may be integrally formed with at least one second connection socket 520.

Optionally, as shown in FIG. 42, the first circuit board 400, one of the second circuit boards 500 and the third circuit board 600 are integrally provided, and the first connection socket 420, one of the second connection sockets 520 and the third connection socket 620 are integrally arranged to simplify the structure of the display apparatus as much as possible.

Figure 43:
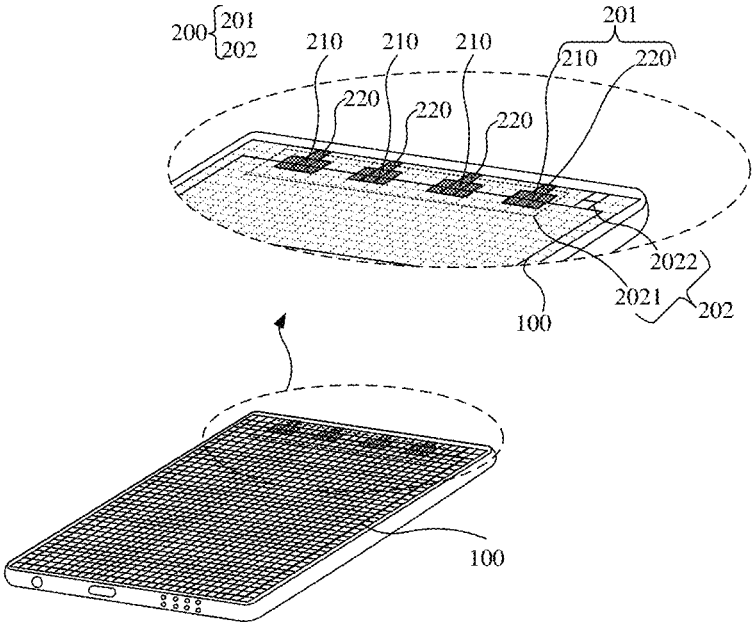
FIG. 43 is a schematic structural view of a wireless communication device according to a third embodiment of a second aspect of the present application.

As shown in FIG. 43, the wireless communication device provided by the embodiments of the present application includes a display panel. The display panel is provided with the loop structure 100 and the antenna 200. The antenna 200 includes the millimeter-wave antenna array 201 and the non-millimeter-wave antenna 202. Both the millimeter-wave antenna array 201 and the non-millimeter-wave antenna 202 are connected to the loop structure 100. The millimeter-wave antenna array 201 includes the millimeter-wave antenna units 210 and the millimeter-wave feeding portions 220, and two or more millimeter-wave antenna units 210 are included in a same millimeter-wave antenna array 201. The non-millimeter-wave antenna 202 includes the non-millimeter-wave radiating portion 2021 and the non-millimeter-wave feeding portion 2022. The non-millimeter-wave radiating portion 2021 is formed by reused two or more millimeter-wave antenna units 210 connected to each other. The non-millimeter-wave feeding portion 2022 is the feeding portion of the non-millimeter wave antenna 202.

Figure 44:
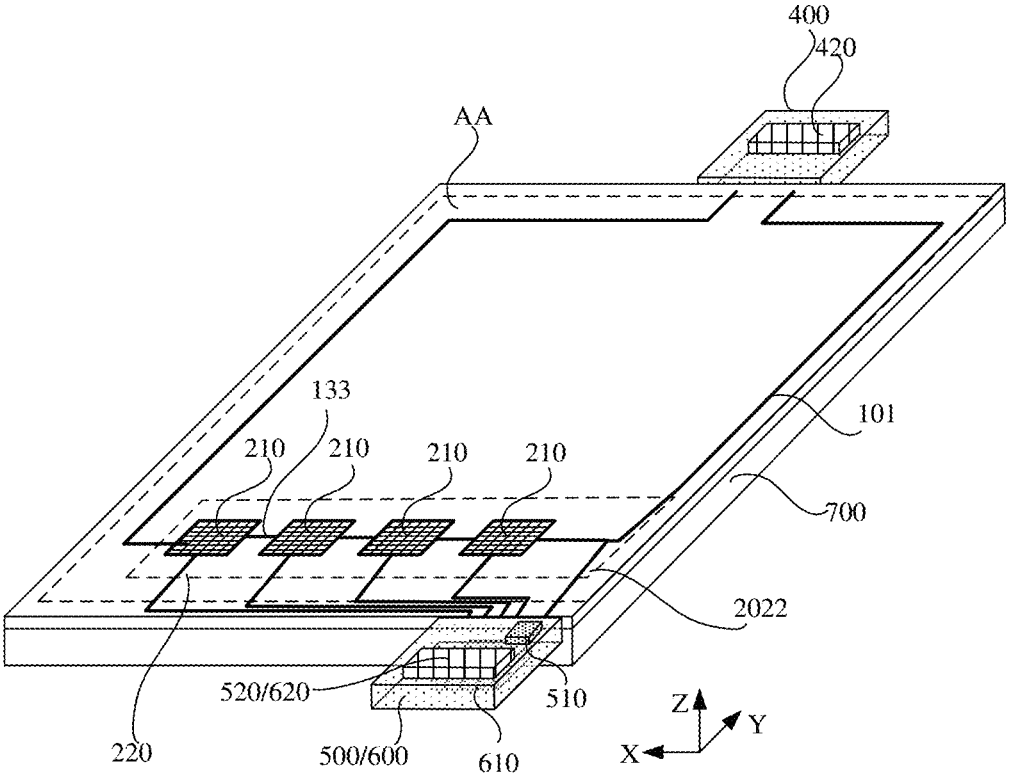
FIG. 44 is a schematic structural view of a wireless communication device according to a fourth embodiment of a second aspect of the present application.
Figure 45:
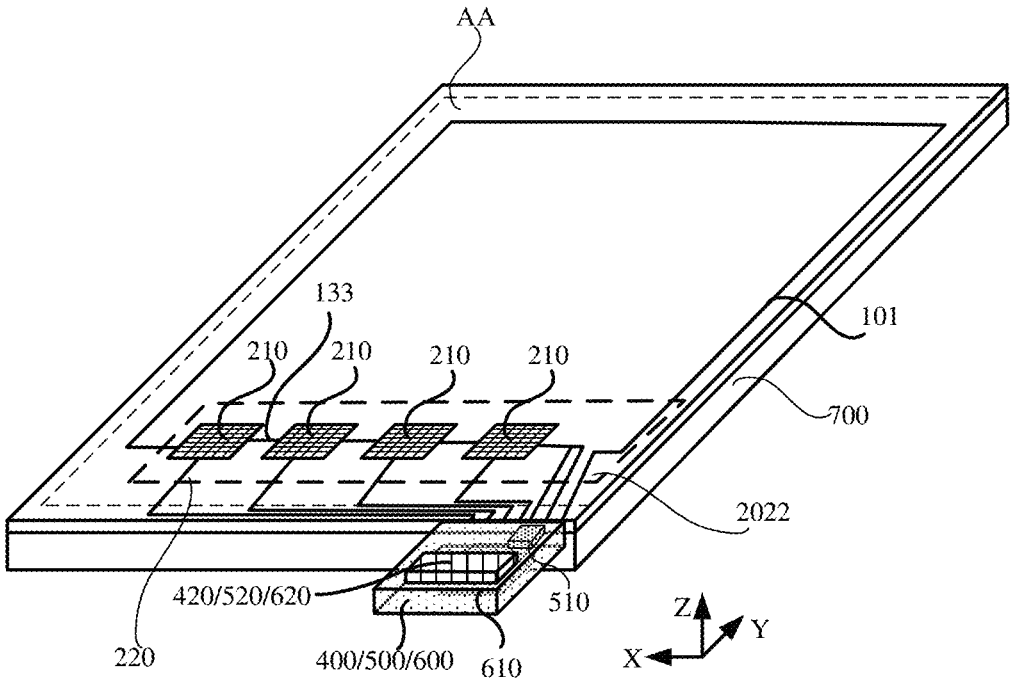
FIG. 45 is a schematic structural view of a wireless communication device according to a fifth embodiment of a second aspect of the present application.

With reference to FIG. 44 to FIG. 45, the wireless communication device further includes the first circuit board 400, the second circuit board 500 and the third circuit board 600. The first circuit board 400 is provided with a first connection socket 420 configured to communicate with the loop structure 100. The second circuit board 500 is provided with the second integrated circuit 510 and the second connection socket 520. The third circuit board 600 is provided with the third integrated circuit 610 and the third connection socket 620. In an embodiment of the present application, the second circuit board 500 and the third circuit board 600 being integrally formed and the second connection socket 520 and the third connection socket 620 being integrally formed is taken as an example for illustration.

In other embodiments, as shown in FIG. 45, the first circuit board 400, the second circuit board 500 and the third circuit board 600 may be integrally formed, and the first connection socket 420, the second connection socket 520 and the third connection socket 620 may also be integrally formed.

Figure 46:
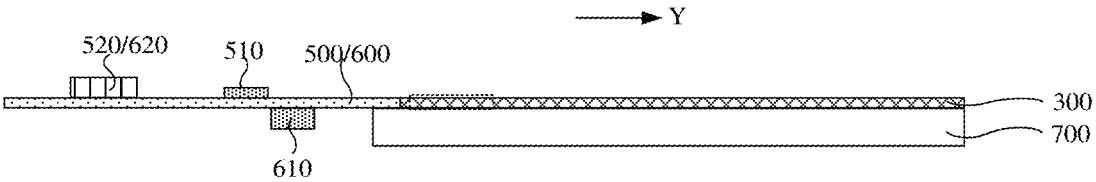
FIG. 46 is a schematic structural view of a wireless communication device according to a sixth embodiment of a second aspect of the present application.
Figure 47:
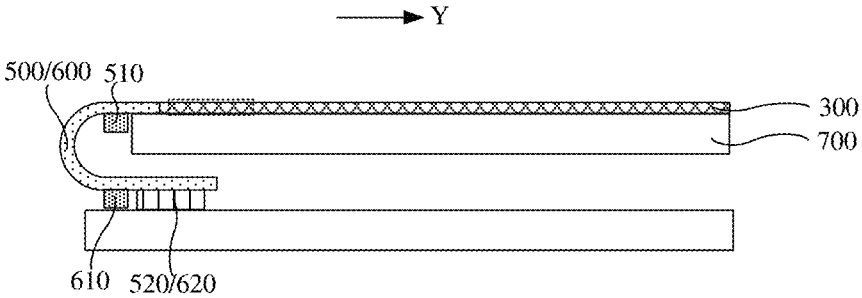
FIG. 47 is a schematic structural view of a wireless communication device according to a seventh embodiment of a second aspect of the present application.

As shown in FIG. 46 and FIG. 47, the wireless communication device further includes a substrate 700. The loop structure 100 and the antenna 200 are arranged in the touch layer 300. The touch layer 300 is arranged on the substrate 700. As shown in FIG. 46, the second circuit board 500 and the third circuit board 600 may be arranged in the non-display area of the wireless communication device. Alternatively, as shown in FIG. 47, the second circuit board 500 and the third circuit board 600 are flexible circuit boards. The second integrated circuit 510 and the third integrated circuit 610 may be bonded by a chip on film (COF) process to the second circuit board 500 and the third circuit board 600. The second circuit board 500 and the third circuit board 600 are bent to a non-display side of the wireless communication device.

In other optional embodiments, the first circuit board 400 may also be a flexible circuit board and is bent to the non-display side of the wireless communication device. When the first circuit board 400, the second circuit board 500 and the third circuit board 600 are integrally formed, the second integrated circuit 510 and the third integrated circuit 610 may be bonded to a same circuit board by the COF process.

Although the present application has been described with reference to the preferred embodiments, various modifications may be made thereto and components thereof may be replaced with equivalents without departing from the scope of the present application. In particular, as long as there is no structural conflict, various technical features mentioned in various embodiments can be combined in any manner. This application is not limited to the specific embodiments disclosed herein, instead, it includes all technical solutions that fall within the scope of the claims.

What is claimed is:

1. A wireless communication structure, comprising:

a loop structure comprising a first connection end, a second connection end and a coil body, at least a part of the coil body being connected between the first connection end and the second connection end;

an antenna connected to the coil body, wherein the antenna comprises a non-millimeter-wave antenna, the non-millimeter-wave antenna comprises a non-millimeter-wave radiating portion and a non-millimeter-wave feeding portion, and the non-millimeter-wave radiating portion is connected to the coil body;

wherein the coil body is provided with one or more first blocking portions, the one or more first blocking portions are configured to allow wireless signal currents transmitted and/or received by the loop structure to pass through and block non-millimeter-wave wireless signal currents transmitted and/or received by the non-millimeter-wave antenna; and wherein the antenna further comprises one or more millimeter-wave antenna units, and the one or more millimeter-wave antenna units are connected to the coil body.

2. The wireless communication structure according to claim 1, wherein the one or more first blocking portions comprise a plurality of first blocking portions, and the plurality of first blocking portions are arranged on both sides of the non-millimeter-wave radiating portion.

3. The wireless communication structure according to claim 1, wherein at least one of the one or more millimeter-wave antenna units is reused as a part of the non-millimeter-wave radiating portion.

4. The wireless communication structure according to claim 3, wherein the coil body is provided with one or more second blocking portions, the one or more second blocking portions are configured to allow wireless signal currents transmitted and/or received by the loop structure and non-millimeter-wave currents transmitted and/or received by the non-millimeter-wave antenna to pass through, and the one or more second blocking portions are configured to block millimeter-wave currents transmitted and/or received by the one or more millimeter-wave antenna units, wherein line widths of the one or more second blocking portions are greater than line widths of the one or more first blocking portions.

5. The wireless communication structure according to claim 4, wherein the one or more second blocking portions comprise a plurality of second blocking portions, and the plurality of second blocking portions are arranged on both sides of one of the one or more millimeter-wave antenna units.

6. The wireless communication structure according to claim 3, wherein the non-millimeter wave radiating portion further comprises a first connection wire for connecting a millimeter-wave antenna unit to the non-millimeter-wave feeding portion, and the first connection wire is a part of the coil body.

7. The wireless communication structure according to claim 1, wherein the one or more millimeter-wave antenna units comprise a plurality of millimeter-wave antenna units, and two or more of the plurality of millimeter-wave antenna units form a millimeter-wave antenna array in combination.

8. The wireless communication structure according to claim 7, wherein each of the plurality of millimeter-wave antenna units in the millimeter-wave antenna array is connected to the coil body, and one of the one or more first blocking portions is arranged between adjacent millimeter-wave antenna units in the millimeter-wave antenna array.

9. The wireless communication structure according to claim 7, wherein the coil body is provided with a second blocking portion, the second blocking portion is connected between adjacent millimeter-wave antenna units, the second blocking portion is configured to allow wireless signal currents transmitted and/or received by the loop structure and non-millimeter-wave currents transmitted and/or received by the non-millimeter-wave antenna to pass through, and the second blocking portion is configured to block millimeter-wave currents transmitted and/or received by the millimeter-wave antenna units.

10. The wireless communication structure according to claim 1, wherein the millimeter-wave antenna units are spaced apart from the non-millimeter-wave radiating portion on an extending path of the coil body, and at least one of the one or more first blocking portions is arranged between the millimeter-wave antenna units and the non-millimeter-wave radiating portion.

11. The wireless communication structure according to claim 1, wherein the loop structure is configured to transmit and/or receive wireless signals in non-millimeter-wave band, the coil body is configured to transmit and/or receive wireless signals in non-millimeter-wave band by coupling.

12. A display panel, comprising the wireless communication structure according to claim 1.

13. The display panel according to claim 12, further comprising a touch layer, wherein the touch layer comprises mesh-shaped metal wiring, and both the loop structure and the antenna are positioned in the touch layer.

14. The display panel according to claim 12, wherein the display panel comprises a first area and a second area surrounding the first area, the first area is a display area, the second area comprises a display area and/or a non-display area, and the loop structure is positioned in the second area;

wherein the coil body is arranged in the second area and surrounds the first area.

15. A wireless communication device, comprising the display panel according to claim 12.

* * * * *